US009464481B2

(12) United States Patent
Kriesels et al.

(10) Patent No.: US 9,464,481 B2
(45) Date of Patent: Oct. 11, 2016

(54) METHOD AND SYSTEM FOR RADIALLY EXPANDING A TUBULAR ELEMENT AND DIRECTIONAL DRILLING

(75) Inventors: Petrus Cornelis Kriesels, Rijswijk (NL); Paolo Lisandrin, Latina (IT)

(73) Assignee: Shell Oil Company, Houston, TX (US)

( * ) Notice: Subject to any disclaimer, the term of this patent is extended or adjusted under 35 U.S.C. 154(b) by 580 days.

(21) Appl. No.: 13/979,518

(22) PCT Filed: Jan. 12, 2012

(86) PCT No.: PCT/EP2012/050401

§ 371 (c)(1),
(2), (4) Date: Jul. 12, 2013

(87) PCT Pub. No.: WO2012/095472

PCT Pub. Date: Jul. 19, 2012

(65) Prior Publication Data

US 2013/0284517 A1 Oct. 31, 2013

(30) Foreign Application Priority Data

Jan. 14, 2011 (EP) ..... 11151019

(51) Int. Cl.

| | |
|---|---|
| ***E21B 7/06*** | (2006.01) |
| ***E21B 43/10*** | (2006.01) |
| ***E21B 7/20*** | (2006.01) |

(52) U.S. Cl.

CPC ..... *E21B 7/062* (2013.01); *E21B 7/067* (2013.01); *E21B 7/068* (2013.01); *E21B 7/20* (2013.01); *E21B 43/103* (2013.01); *E21B 43/108* (2013.01)

(58) Field of Classification Search

CPC ..... E21B 7/062; E21B 43/108; E21B 7/20; E21B 7/068; E21B 43/103; E21B 7/067; E21B 7/04; E21B 7/06

See application file for complete search history.

(56) References Cited

U.S. PATENT DOCUMENTS

| | | | | |
|---|---|---|---|---|
| 4,501,337 A * | 2/1985 | Dickinson, III | ..... | E21B 7/04 175/171 |
| 5,803,666 A * | 9/1998 | Keller | ..... | E21B 7/30 405/146 |
| 7,281,422 B2 * | 10/2007 | Keller | ..... | E21B 47/10 166/250.02 |

(Continued)

FOREIGN PATENT DOCUMENTS

| | | | | |
|---|---|---|---|---|
| EP | 0044706 | 1/1982 | ..... | E21B 7/00 |
| EP | 10190010.8 | 11/2010 | ..... | E21B 7/20 |

(Continued)

OTHER PUBLICATIONS

PCT International Search Report, Application No. PCT/EP2012/050401 dated May 2, 2013.

*Primary Examiner* — Elizabeth Gitlin

(57) ABSTRACT

The invention relates to a system and method for radially expanding a tubular element. The method comprises the steps of bending the tubular element radially outward and in axially reverse direction so as to form an expanded tubular section extending around an unexpanded tubular section, wherein bending occurs in a bending zone; increasing the length of the expanded tubular section by pushing the unexpanded tubular section in axial direction relative to the expanded tubular section; operating a drill string, which extends through the unexpanded tubular section and is provided with a drill bit at a downhole end thereof, to drill a borehole; and operating directional drilling means, which are coupled to the drill string, to deviate the borehole and direct the borehole along a predetermined path.

11 Claims, 21 Drawing Sheets

(56) References Cited

U.S. PATENT DOCUMENTS

| | | | | |
|---|---|---|---|---|
| 7,387,174 | B2 * | 6/2008 | Lurie | E21B 7/20 175/171 |
| 7,946,359 | B2 * | 5/2011 | Jeffryes | E21B 43/103 175/325.1 |
| 2004/0112639 | A1 | 6/2004 | Chen et al. | 175/22 |
| 2009/0255689 | A1 * | 10/2009 | Kriesels | E21B 43/105 166/384 |
| 2009/0288842 | A1 * | 11/2009 | Kriesels | E21B 43/103 166/384 |
| 2015/0267474 | A1 * | 9/2015 | Kriesels | F16L 1/026 175/5 |

FOREIGN PATENT DOCUMENTS

| | | | |
|---|---|---|---|
| GB | 2438508 | 11/2007 | E21B 7/20 |
| WO | WO2008006841 | 1/2008 | E21B 43/10 |
| WO | WO2008049826 | 5/2008 | E21B 43/10 |
| WO | WO2008061969 | 5/2008 | E21B 43/10 |
| WO | WO2009074643 | 6/2009 | E21B 43/10 |

* cited by examiner

METHOD AND SYSTEM FOR RADIALLY EXPANDING A TUBULAR ELEMENT AND DIRECTIONAL DRILLING

PRIORITY CLAIM

The present application claims priority from PCT/EP2012/050401, filed Jan. 12, 2012, which claims priority from European application 11151019.4, filed Jan. 14, 2011, which is incorporated herein by reference.

The present invention relates to a method and a system for radially expanding a tubular element, which is suitable for directional drilling. The method and system of the application can be applied for lining a wellbore.

The technology of radially expanding tubular elements in wellbores is increasingly applied in the industry of oil and gas production. Wellbores are generally provided with one or more casings or liners to provide stability to the wellbore wall and/or to provide zonal isolation between different earth formation layers. The terms "casing" and "liner" refer to tubular elements for supporting and stabilising the wellbore wall, whereby it is generally understood that a casing extends from surface into the wellbore and that a liner extends from a downhole location further into the wellbore. However, in the present context, the terms "casing" and "liner" are used interchangeably and without such intended distinction.

In conventional wellbore construction, several casings are set at different depth intervals, and in a nested arrangement. Herein, each subsequent casing is lowered through the previous casing and therefore has a smaller diameter than the previous casing. As a result, the cross-sectional wellbore size that is available for oil and gas production decreases with depth.

To alleviate this drawback, it is possible to radially expand one or more tubular elements at a desired depth in the wellbore, for example to form an expanded casing, expanded liner, or a clad against an existing casing or liner.

Also, it has been proposed to radially expand each subsequent casing to substantially the same diameter as the previous casing to form a monodiameter wellbore. It is thus achieved that the available diameter of the wellbore remains substantially constant along (a section of) its depth as opposed to the conventional nested arrangement.

EP-1438483-B1 discloses a method of radially expanding a tubular element in a wellbore whereby the tubular element, in unexpanded state, is initially attached to a drill string during drilling of a new wellbore section. Thereafter the tubular element is radially expanded and released from the drill string.

To expand such wellbore tubular element, generally a conical expander is used with a largest outer diameter substantially equal to the required tubular diameter after expansion. The expander is pumped, pushed or pulled through the tubular element. Such method can lead to high friction forces that need to be overcome, between the expander and the inner surface of the tubular element. Also, there is a risk that the expander becomes stuck in the tubular element.

EP-0044706-A2 discloses a method of radially expanding a flexible tube of woven material or cloth by eversion thereof in a wellbore, to separate drilling fluid pumped into the wellbore from slurry cuttings flowing towards the surface. However, the woven material or cloth has insufficient strength to support the borehole wall and to replace conventional casing.

Although in some applications the known expansion techniques have indicated promising results, there is a need for an improved method of radially expanding a tubular element.

WO-2008/006841 discloses a wellbore system for radially expanding a tubular element in a wellbore. The wall of the tubular element is induced to bend radially outward and in axially reverse direction so as to form an expanded section extending around an unexpanded section of the tubular element. The length of the expanded tubular section is increased by pushing the unexpanded section into the expanded section. Herein the expanded section retains the expanded tubular shape after eversion. At its top end, the unexpanded section can be extended, for instance by adding pipe sections or by unreeling, folding and welding a sheet of material into a tubular shape.

In addition to the systems for expanding tubular elements in boreholes as described above, several systems for directional drilling exist, which are able to drill curved boreholes, as well as the conventional straight boreholes. However, the known systems for directional drilling prove to be unsuitable for the system as disclosed in WO-2008/006841.

The present invention aims to improve the above described method and system.

The invention therefore provides a method for radially expanding a tubular element, the method comprising the steps of:

- bending the tubular element radially outward and in axially reverse direction so as to form an expanded tubular section extending around an unexpanded tubular section, wherein bending occurs in a bending zone;
- increasing the length of the expanded tubular section by pushing the unexpanded tubular section in axial direction relative to the expanded tubular section;
- operating a drill string, which extends through the unexpanded tubular section and is provided with a drill bit at a downhole end thereof, to drill a borehole; and
- operating directional drilling means, which are coupled to the drill string, to deviate the borehole and direct the borehole along a predetermined path.

Thus, the tubular element is effectively turned inside out during the bending process. The bending zone defines the location where the bending process takes place. By inducing the bending zone to move in axial direction along the tubular element it is achieved that the tubular element is progressively expanded without the need for an expander that is pushed, pulled or pumped through the tubular element.

It is preferred that the tubular element includes a material that is plastically deformed in the bending zone during the bending process so that the expanded tubular section retains an expanded shape as a result of said plastic deformation. In this manner it is achieved that the expanded tubular section retains its shape due to plastic deformation, i.e. permanent deformation, of the wall. Thus, the expanded tubular section maintains its expanded shape, without the need for an external force or pressure to maintain its expanded shape. If, for example, the expanded tubular section has been expanded against the wellbore wall as a result of said bending of the wall, no external radial force or pressure needs to be exerted to the expanded tubular section to keep it against the wellbore wall.

Suitably the wall of the tubular element comprises a metal, such as steel or any other ductile metal capable of being plastically deformed by eversion of the tubular element. The expanded tubular section then has adequate collapse resistance, for example in the order of 100 or 150 bars or more.

If the tubular element extends vertically in the wellbore, the weight of the unexpanded tubular section can be utilised to contribute to the force needed to induce downward movement of the bending zone.

Suitably the bending zone is induced to move in axial direction relative to the unexpanded tubular section by inducing the unexpanded tubular section to move in axial direction relative to the expanded tubular section. For example, the expanded tubular section is held stationary while the unexpanded tubular section is moved in axial direction through the expanded tubular section to induce said bending of the wall.

In order to induce said movement of the unexpanded tubular section, preferably the unexpanded tubular section is subjected to an axially compressive force acting to induce said movement. The axially compressive force preferably at least partly results from the weight of the unexpanded tubular section. If necessary the weight can be supplemented by an external, downward, force applied to the unexpanded tubular section to induce said movement. As the length, and hence the weight, of the unexpanded tubular section increases, an upward force may need to be applied to the unexpanded tubular section to prevent uncontrolled bending or buckling in the bending zone.

If the bending zone is located at a lower end of the tubular element, whereby the unexpanded tubular section is axially shortened at a lower end thereof due to said movement of the bending zone, it is preferred that the unexpanded tubular section is axially extended at an upper end thereof in correspondence with said axial shortening at the lower end thereof. The unexpanded tubular section gradually shortens at its lower end due to continued reverse bending of the wall. Therefore, by extending the unexpanded tubular section at its upper end to compensate for shortening at its lower end, the process of reverse bending the wall can be continued until a desired length of the expanded tubular section is reached. The unexpanded tubular section can be extended at its upper end, for example, by connecting a tubular portion to said upper end in any suitable manner such as by welding. Alternatively, the unexpanded tubular section can be provided in the form of a coiled tubing which is unreeled from a reel and gradually inserted into the wellbore. Thus, the coiled tubing is extended at its upper end by unreeling from the reel.

As a result of forming the expanded tubular section around the unexpanded tubular section, an annular space is formed between the unexpanded and expanded tubular sections. To increase the collapse resistance of the expanded tubular section, a pressurized fluid can be inserted into the annular space. The fluid pressure can result solely from the weight of the fluid column in the annular space, or in addition also from an external pressure applied to the fluid column.

The expansion process is suitably initiated by bending the wall of the tubular element at a lower end portion thereof.

The unexpanded tubular section and the drill string may be lowered simultaneously during drilling with the drill string.

To reduce any buckling tendency of the unexpanded tubular section during the expansion process, the unexpanded tubular section may be centralised within the expanded section by any suitable centralising means.

According to another aspect, the invention provides a system for radially expanding a tubular element, comprising:

- a tubular element being bend radially outward and in axially reverse direction so as to form an expanded tubular section extending around an unexpanded tubular section, wherein bending occurs in a bending zone;
- a pipe pusher for increasing the length of the expanded tubular section by inducing the expanded tubular section to move in axial direction relative to the unexpanded tubular section;
- a drill string, which extends through the unexpanded tubular section and is provided with a drill bit at a downhole end thereof, for drilling a borehole; and
- directional drilling means, which are coupled to the drill string, to deviate the borehole and direct the borehole along a predetermined path.

The invention will be described hereinafter in more detail and by way of example, with reference to the accompanying drawings, wherein.

In the Figures and the description like reference numerals relate to like components.

Figure 1:
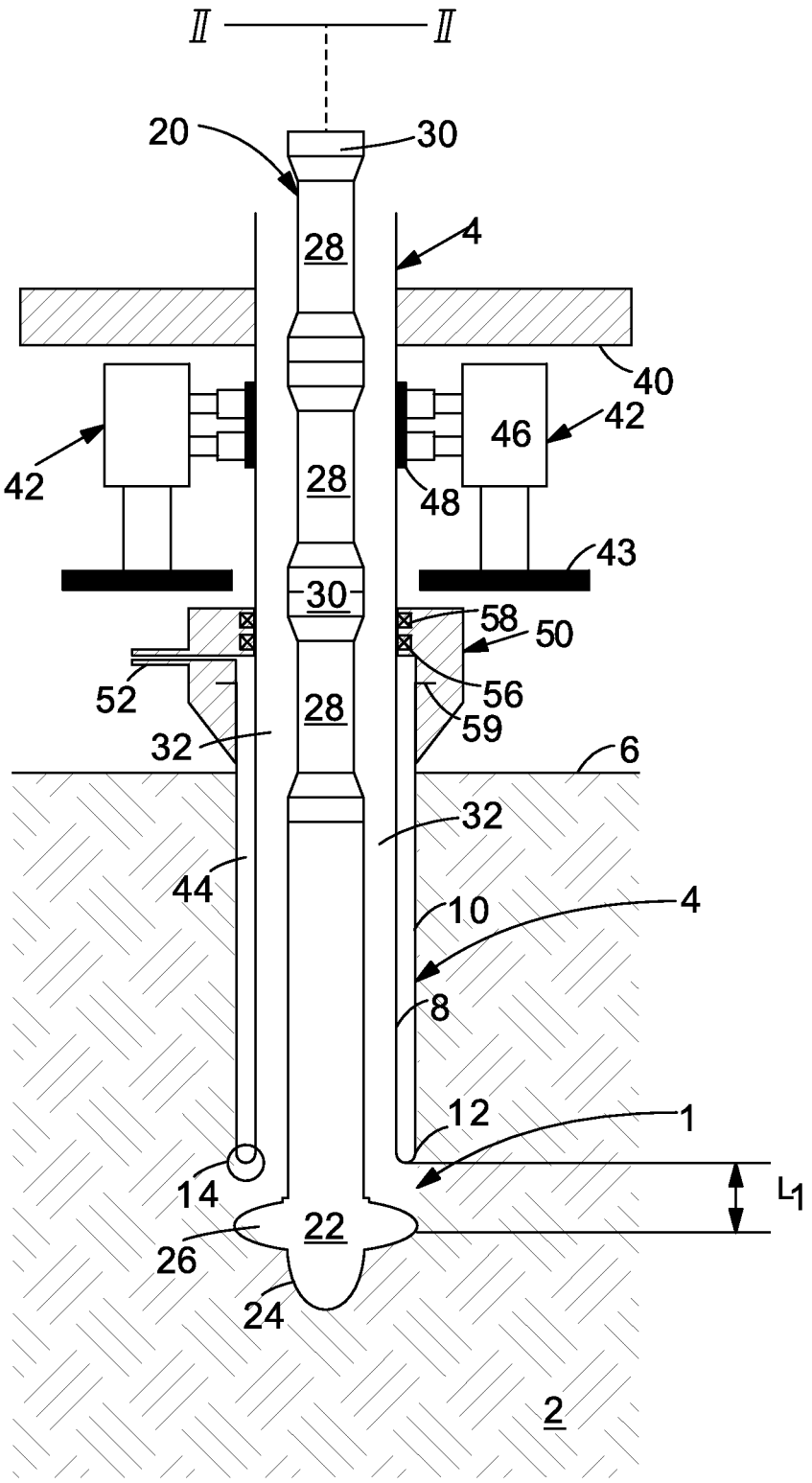
FIG. 1 shows a vertical cross section of a lower part of a system for radially expanding a tubular element.

FIG. 1 shows a wellbore 1 formed in an earth formation 2. A radially expandable tubular element 4, for instance an expandable steel liner, extends from surface 6 down into the wellbore 1. The tubular element 4 comprises an unexpanded tubular section 8 and a radially expanded tubular section 10. The unexpanded section 8 extends within the expanded section 10. An outer diameter of the expanded tubular section 10 may be substantially equal to the diameter of the wellbore 1.

Although the wellbore shown in FIG. 1 extends vertically into the formation 2, the present invention is equally suitable for any other wellbore. For instance, the wellbore 1 may extend at least partially in horizontal direction. Herein below, upper end of the wellbore refers to the end at surface 6, and lower end refers to the end down hole.

At its lower end, the wall of the unexpanded section 8 bends radially outward and in axially reverse direction so as to form a curved lower section 12, defining a bending zone 14 of the tubular element 4. The curved section 12 is U-shaped in cross-section and interconnects the unexpanded section 8 and the expanded section 10.

A drill string 20 may extend from surface through the unexpanded liner section 8 to the lower end of the wellbore 1. The lower end of the drill string 20 is provided with a drill bit 22. The drill bit comprises, for instance, a pilot bit 24 having an outer diameter which is slightly smaller than the internal diameter of the unexpanded liner section 8, and a reamer section 26 having an outer diameter adapted to drill the wellbore 1 to its nominal diameter. The reamer section 26 may be radially retractable to a smaller outer diameter, allowing it to pass through the unexpanded liner section 8, so that the drill bit 22 can be retrieved through the unexpanded liner section 8 to surface.

The drill string 20 may comprise multiple drill pipe sections 28. The pipe sections 28 may be mutually connected at respective ends by male and female threaded connections 30. An annular space 32 between the drill string 20 and the unexpanded tubular section 8 is referred to as the drilling annulus 32.

The connections 30 are not shown in detail, but comprise for instance threaded, pin and box type connections. The connections 30 may comprise joints fabricated with male threads on each end, wherein short-length coupling members (not shown) with female threads are used to join the individual joints of drill string together, or joints with male threads on one end and female threads on the other. Said threaded connections may comprise connections which are standardized by the American Petroleum Institute (API).

FIG. 1 also shows a rig floor 40, which is elevated with respect to the surface 6 and encloses an upper end of the drill string 20 and of the unexpanded tubular section 8. The rig floor 40 is part of a drilling rig, which is however not shown in its entirety. A pipe pusher 42, which is for instance arranged below the rig floor, may enclose the unexpanded section 8. The pipe pusher is for instance supported by base frame 45. The base frame 45 provides stability, and may for instance be connected to the drilling rig or be supported at surface 6. The pipe pusher may comprise one or more motors 46, which are arranged on the base frame, and one or more conveyer belts 48 which can be driven by the respective motors. Each conveyer belt 48 engages the outside of the unexpanded section 8. The conveyer belts 48 can exert force to said unexpanded section 8 to force the unexpanded section to move into the expanded section 10. Other embodiments of the pipe pusher 42 are conceivable, which will be able to exert downward or upward force to the unexpanded section.

A sealing device 50 can be connected to the upper end of the expanded liner section 10 to seal the unexpanded liner section 8 relative to the expanded liner section 10. Herein, the sealing device 50 enables the unexpanded liner section 8 to slide in axial direction relative to the sealing device 50. The sealing device comprises a conduit 52 which is connected to a pump (not shown) for pumping fluid into or out of a blind annulus 44. The bling annulus herein is the annular space between the unexpanded liner section 8 and the expanded liner section 10. The annular space 44 is referred to as blind annulus as it is closed at the downhole end by the bending zone 14. The sealing device may include one, two or more annular seals 56, 58. The seals 56, 58 engage the outside of the unexpanded section 8 and prevent said fluid to exit the blind annulus. Preferably, the sealing device 50 comprises at least two seals 56, 58 to provide at least one additional seal to improve safety and reliability in case the first seal may fail.

The sealing device 50 can be regarded as a blind annulus blow out preventer (BABOP). Therefore, the seals 56, 58, the connection of the device 50 to the upper end of expanded section 10, and one or more valves (not shown) for closing conduit 52 will all be designed to at least withstand fluid pressures that may arise in a well control situation. Depending on specifics of the formation, the sealing device 50 is for instance designed to withstand pressures that may be expected in case of a blowout, for instance in the range of about 200 bar to about 1600 bar, for instance about 400 bar to 800 bar, or more. Such pressures may for instance arise in the blind annulus 44 in case of a failure, for instance due to (local) rupture, of the expandable tubular 4 in combination with a well control situation.

The expanded liner section 10 is axially fixed, by any suitable fixation means, to prevent axial movement. The expanded liner section 10 may be fixated at its upper end at surface. For instance, said upper end of the expanded section may be connected to a ring or flange 59, for instance by welding and/or screwing. Said ring can be attached to or incorporated in any suitable structure at surface, such as the sealing device 50. The inner diameter of said ring may be larger than the outer diameter of the expanded section. Optionally, the expanded section 10 may be fixed to the wellbore wall 12, for instance by virtue of frictional forces between the expanded liner section 10 and the wellbore wall 12 as a result of the expansion process. Alternatively, or in addition, the expanded liner section 10 can be anchored, for instance to the wellbore wall, by any suitable anchoring means.

Figure 2:
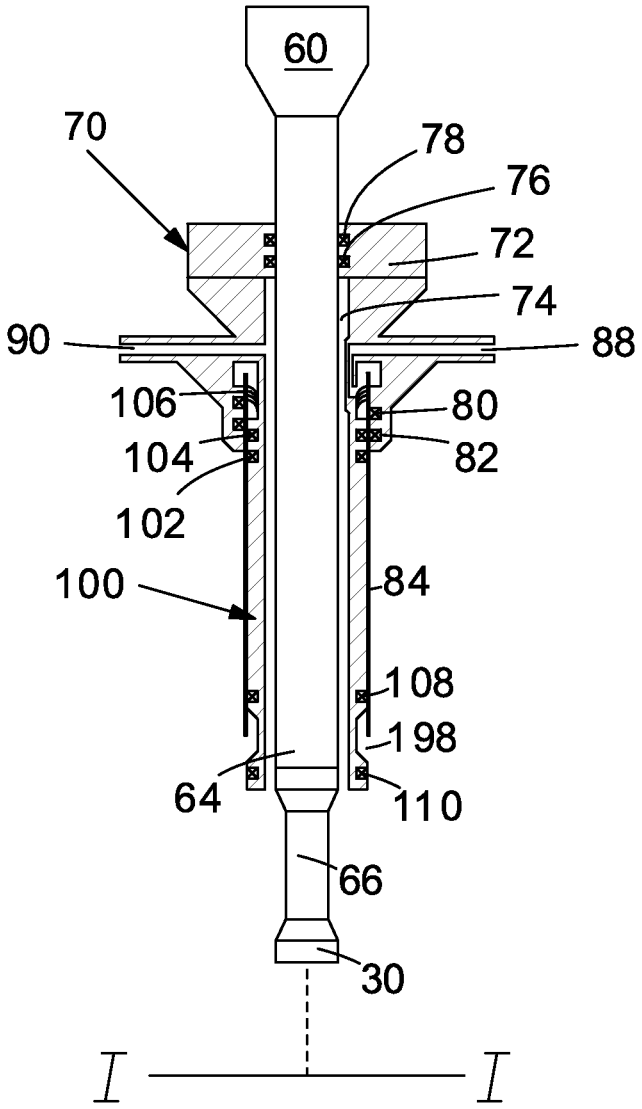
FIG. 2 shows a vertical cross section of an example of an upper part of the system of FIG. 1.
Figure 3:
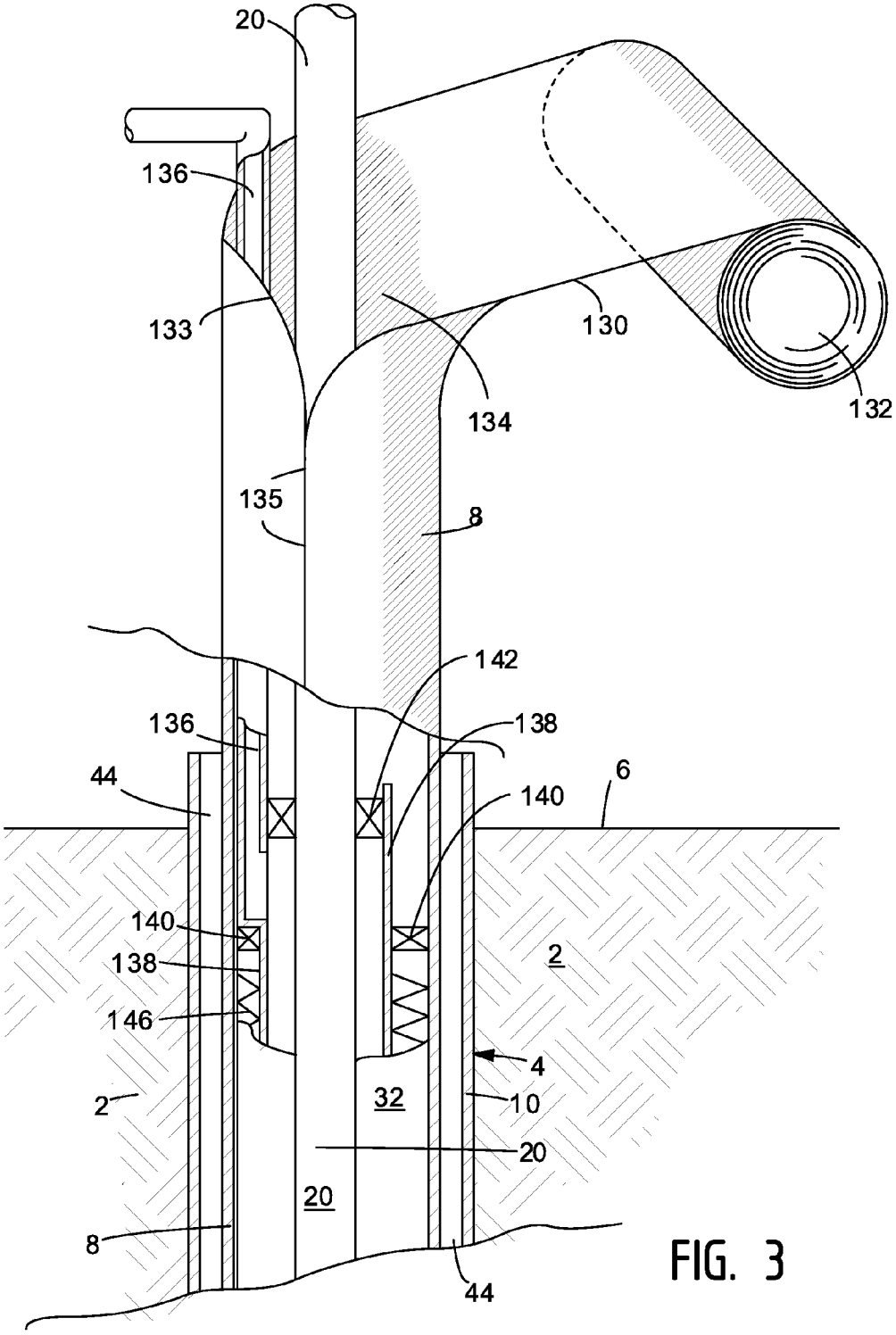
FIG. 3 shows a vertical cross section of another example of an upper part of the system of FIG. 1.

At the interface indicated by the line II-II, the lower portion of the system shown in FIG. 1 can be connected to an upper portion as for instance shown in FIGS. 2 and 3.

FIG. 2 shows a top drive 60 connected to an upper end connection part 62, which is rotatable with respect to the top drive. Preferably, the upper end connection part comprises a flush pipe, having a smooth outer surface. The pipe end 64, which is remote from the top drive, is provided with a threaded connection 30 as described above. The threaded end 64 is connected to an additional drill string section 66. Typically, the additional drill string section 66 will be substantially equal to the drill string sections 28, shown in FIG. 1. At the interface indicated by line I-I, the additional drill pipe section 66 can be connected to the upper end of the drill string 20 shown in FIG. 1.

A drilling annulus sealing device 70 may cover the top end of the drilling annulus 32. The sealing device 70 comprises a housing 72, which encloses the connection part 62 and provides an internal space 74. At the top end, near the top drive 60, the housing comprises one, two or more seals 76, 78, which engage the outside of the pipe 62. Preferably, the seals 76, 78 enable the housing to slide along the pipe 62. At the opposite end, the housing may comprise one, two or more seals 80, 82 which engage the outside of an additional expandable pipe section 84. In addition to the seals, the housing may comprise grippers 106, which may engage the outside and/or the inside of the pipe section 84. An activation line 88 is connected to the housing for activating or releasing the seals 80, 82 and/or the grippers 86. A fluid conduit 90 is connected to the internal space 74 for supply or drainage of (drilling) fluid to or from the annular space 32.

The sealing device 70 may comprise an extending part or stinger 100. The stinger extends into the inside of the additional expandable pipe section 84. The stinger may comprise seals 102, 104 and/or grippers 106 to engage the upper end of the pipe section 84. The stinger may also comprise seals 108 to engage a lower end of the pipe section 84, and seals 110 to engage the inside of the upper end of the unexpanded tubular section 8 (shown in FIG. 1). A backing gas tool 198 may be integrated in the stinger between the seals 108, 110. The backing gas tool covers the inner interface between the additional expandable pipe section 84 and the unexpanded tubular section 8.

The stinger may be at least slightly longer than the pipe section 84 so that the stinger may extend into the unexpanded section 8, which will enable the stinger to function as an alignment tool for aligning the pipe section 84 and the unexpanded section 8.

In practice, the length of the pipe section 84 may be in the range of about 5-20 meters, for instance 10 meters. The stinger will for instance be about 2% to 10% longer, for instance 5% longer than the pipe section 84. An annular space 112 is provided between the stinger and the pipe 62 to provide a fluid connection from the annulus 32 to the space 74 and the conduit 90.

The sealing device 70 may be referred to as drilling annulus blow out preventer (DABOP) 70. The seals 76-82, the grippers 86, and one or more valves (not shown) for closing conduits 88 and 90 will all be designed to at least withstand fluid pressures that may arise in a well control situation. Depending on specifics of the formation and the expected maximum pore pressures, the DABOP 70 is for instance designed to withstand pressures for instance in the range of about 200 bar to about 1600 bar, for instance about 400 bar to 800 bar, or more.

The DABOP may comprise any number of seals. The DABOP 70 may comprise one seal 76 and one seal 80, or a plurality of seals. In a practical embodiment, two seals 76, 78 to seal with respect to the pipe 62 and two seals to seal with respect to the tubular section 84 will provide a balance between for instance fail-safety and reliability on one hand and costs on the other hand. For instance, the double barrier provided by the inner seals 102, 104, engaging the inside of the expandable pipe 84, and the outer seals 80, 82, engaging the outside of the expandable pipe 84, improves the reliability and leak-tightness of the sealing device 70.

FIG. 3 shows an upper portion of the system of FIG. 1. The unexpanded liner section 8 is at its upper end formed from a (metal) sheet 130 wound on a reel 132. The metal sheet 130 has opposite edges 133, 134. After unreeling from the reel 132, the metal sheet 130 is bent into a tubular shape and the edges 133, 134 are interconnected, for instance by welding, to form the unexpanded tubular section 8. Consequently, the expandable tubular element 4 may comprise a longitudinal weld 135.

A fluid conduit 136 extends from the interior of the unexpanded tubular section 8, to above the upper end of the unexpanded tubular section 8. The fluid conduit 136 may at its lower end be connected to, or integrally formed with, a tube 138 located in the unexpanded tubular section 8. A first annular seal 140 seals the tube 138 relative to the unexpanded liner section 8, and a second annular seal 142 seals the tube 138 relative to the drill string 20. The fluid conduit 136 is in fluid communication with the interior space of the tube 38 via an opening 144 provided in the wall of the tube 138. Furthermore the tube 138 is provided with gripper means 146 allowing upward sliding, and preventing downward sliding, of the tube 138 relative to the unexpanded liner section 8. The first annular seal 140 allows upward sliding of the tube 138 relative to the unexpanded liner section 8.

The upper portion shown in FIG. 3 can be combined with the lower portion shown in FIG. 1, wherein the unexpanded tubular section 8 can be continuously formed around the drill string 20. Herein, some of the features shown in FIG. 1 are omitted in FIG. 3 to improve the clarity of the latter figure, such as the sealing device 50, the pipe pusher 42 and the drilling floor 40.

Figure 4:
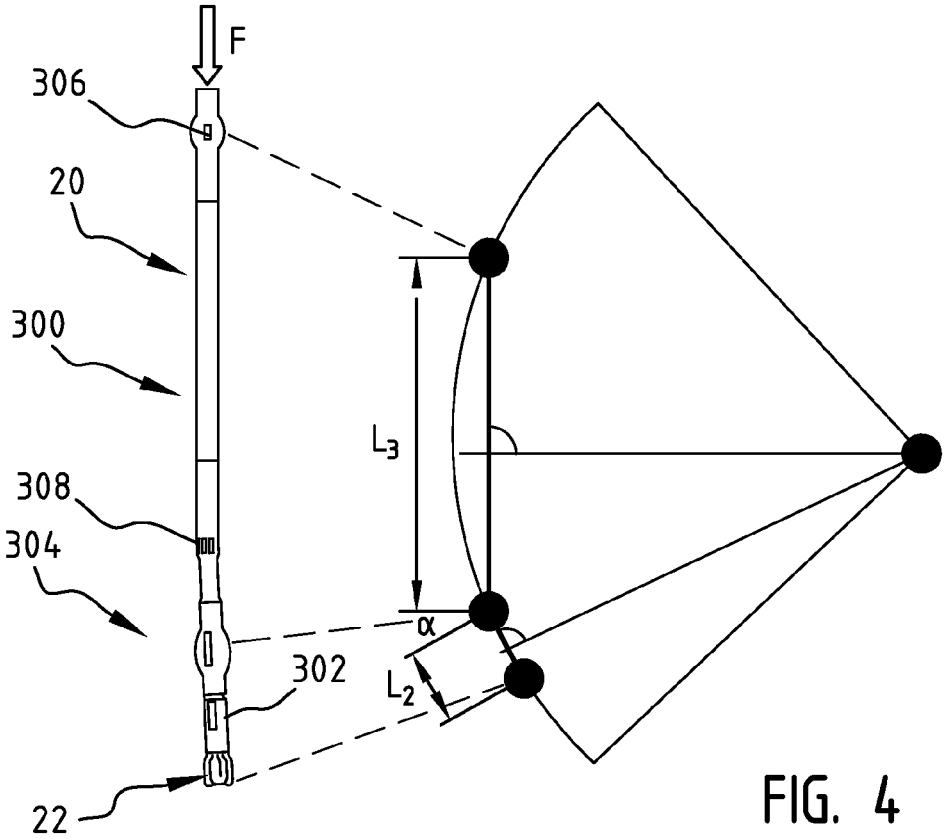
FIG. 4 shows a schematic side view of a detail of a steerable drilling system.

FIG. 4 shows a general example of a steerable drilling system 300, wherein the lower end of the drill string 20 is provided with a bottom hole assembly 304 including a motor 302 which can drive the drill bit 22. A longitudinal axis of the motor 302 is arranged at a predetermined angle $\alpha$ with respect to the drill string 20. Above the bottom hole assembly, the drill string is provided with an upper stabilizer 306 and a lower stabilizer 308.

The system 300 can be adjusted between a first or rotary mode and a second or sliding mode. In the rotary mode, the drill string 20 rotates and the drilled borehole will be straight. Due to the angle $\alpha$, the inner diameter of the borehole will be larger than the outer diameter of the drill bit 22. In the sliding mode, only a lower end part of the motor 302 rotates. Herein, the motor can include a so-called mud motor, which can be driven by a pressurized flow of drilling fluid (mud) supplied through the drill string 20. By pushing on the drill string from surface, a deviated (i.e. non-straight or curved) borehole can be generated. Turning of the bottom hole assembly is obtained by pivoting action of the two motor stabilizers 306, 308 and the drill bit 22 against the borehole wall.

At least the following problems are encountered when using the steerable drilling system 300 (FIG. 4) in combination with the system expanding the tubular element 4 as shown in any of FIGS. 1-3:

1) It is preferred to both under-ream and steer the drilling. Herein, under-ream means enlarging the borehole with respect to the outer diameter of the pilot bit 24. This is typically achieved by using the underreamer 26 having a larger outer diameter. It proves to be difficult to combine under-reaming and steering using a motor with a bent housing as shown in FIG. 4.

2) When drilling a borehole in combination with the liner system of any of FIGS. 1-3, it is preferred to be able to determine the relative position of the bending zone 14 and the drill bit 22. Herein, in a preferred embodiment the distance L1 between the bending zone 14 and the drilling tools 22 (which may include the pilot bit 24 and the under-reamer 26) is kept relatively small, in order to set the casing immediately after the borehole is created. The relatively small distance L1 implies a relatively short open hole section, which is a major advantage of the lining system with respect to conventional casing systems.

The embodiments described below present examples how to overcome these problems.

Figure 5A:
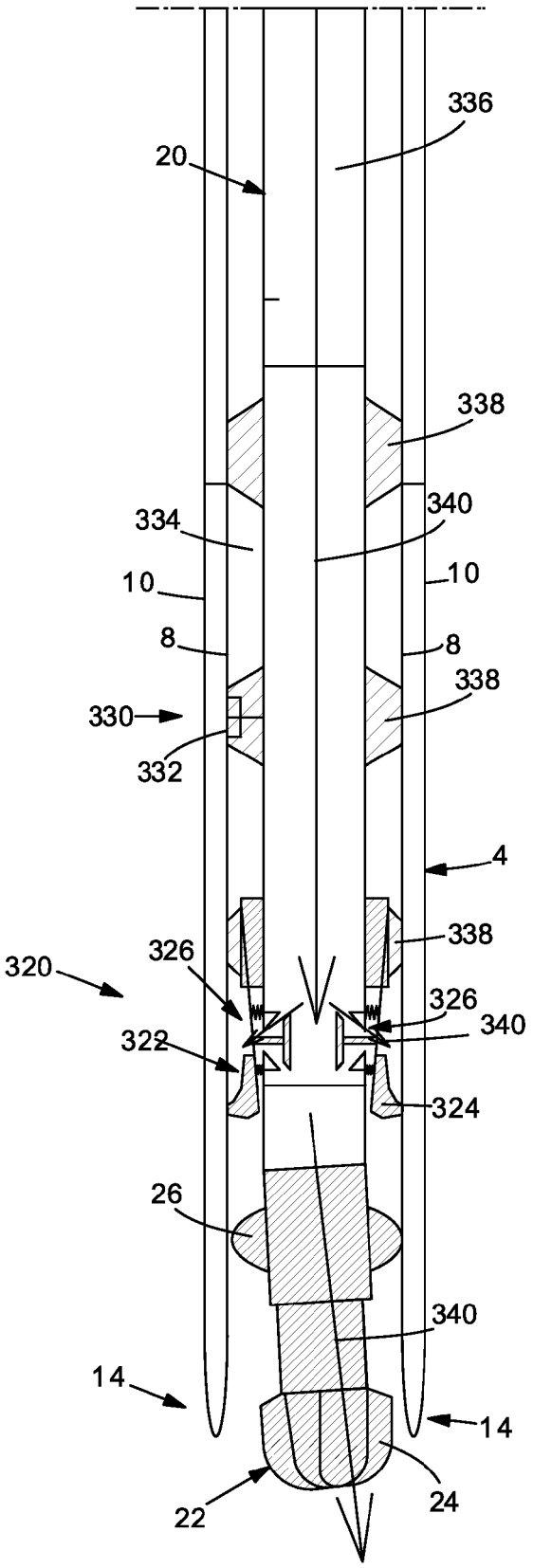
FIG. 5A shows a cross section of a detail of an embodiment of the system of the invention in a first state.

FIG. 5A shows the drill string 20, which is arranged to transfer axial and torsional loads and movement from the drilling rig (FIG. 1) to a drilling assembly 320 downhole. The drilling assembly itself is composed of a motor 302 and a bit 22. The bit 22 may include a pilot bit 24 and an under-reamer 26. In addition, the drilling assembly comprises a (mechanical) positioning tool 322. The positioning tool includes one or more grippers 324. The grippers may be connected to one or more spring loaded valves 326. A pressure release system 330 includes a fluid chamber 332 and a conduit 334 to connect to fluid chamber to an internal fluid passage 336 for drilling fluid 340 inside the drill string 20. The fluid chamber 332 is provided with seals that can seal the fluid chamber with respect to the inner surface of the unexpanded liner section 8. Said seals can open or close as a function of the position of the drilling assembly relative to the bending zone 14. The outside of the motor 302 is provided with one, two or more stabilizers 338. The stabilizers are connected to the motor and can slide along the inner surface of the unexpanded section. The stabilizers engage said inner surface of the unexpanded section 8 to stabilize the motor.

Figure 5B:
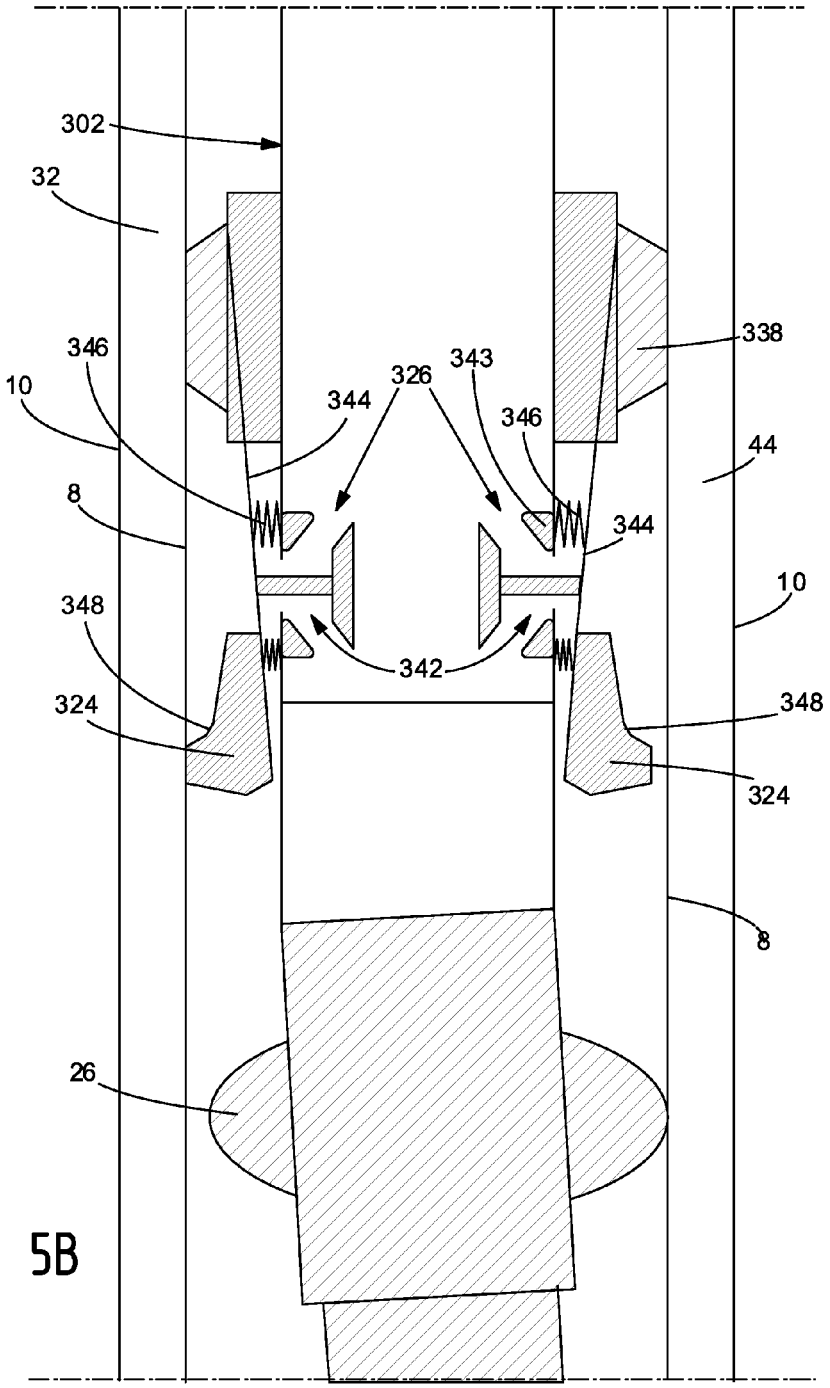
FIG. 5B shows a detail of FIG. 5A.

As shown in FIG. 5B, the spring loaded valves 326 are moveable between an open state (shown in FIG. 5B) or a closed state, depending on the position of the drilling assembly with respect to the bending zone 14. The spring loaded valves 326 are moveably arranged in openings 342 which provide a fluid connection between the inside of the motor 302 and the annulus 32. Said openings are provided with valve seats 343 to improve fluid tightness in the closed position of the valves. The valves 326 are connected to a lever 344 loaded by a spring 346. Said levers are also connected to one or more grippers 324. An outside surface 348 of each gripper 324 is formed to correspond or substantially fit to the inside of the bending zone 14 of the tubular element 4 (FIG. 6).

Hence, as shown in FIG. 5, when the drilling assembly 320 is inside the tubular element 4, the mechanical gripper system 322 is inactive. The spring loaded valves 326 are in an open position, i.e. the openings 342 are open. As drilling fluid 340 can exit the drilling assembly through the openings 342, the pressure inside the drilling assembly is relatively low, which can be measured and observed from surface. Herein, low pressure may include pressures in the range of about 55-65 bar, for instance. Said low pressure also ensures that the under-reamer 26 remains inactivated, i.e. in its retracted state having an outer diameter which is smaller than the inner diameter of the unexpanded section 8, to ensure that the under-reamer 26 does not damage the tubular element 4. The pressure release system 330 is closed at this stage, ensuring that the bit and under-reamer can be rotated as the drilling assembly is run in through the unexpanded section 8.

Figure 6:
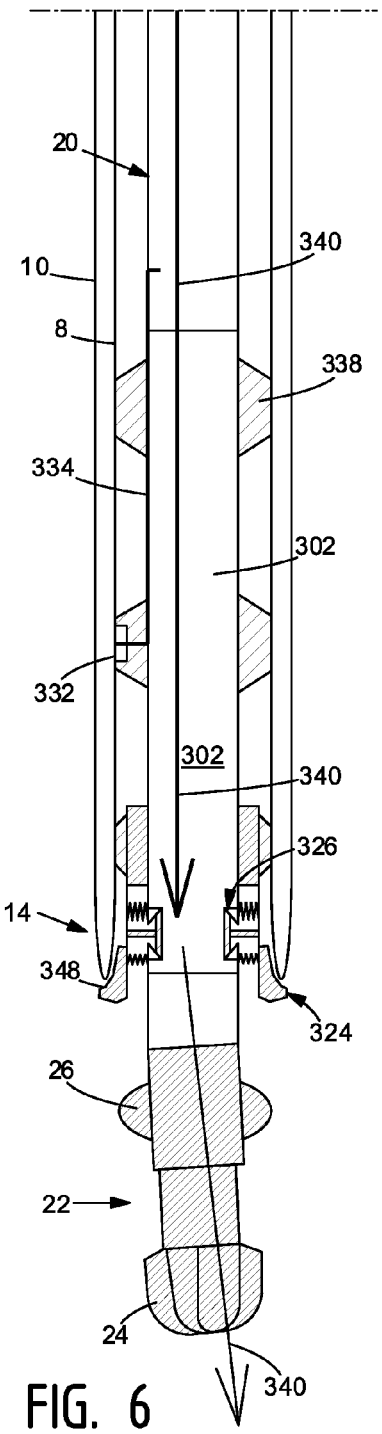
FIG. 6 shows a cross section of the embodiment of FIG. 5 in a second state.

As shown in FIG. 6, surface 348 of the grippers 324 will engage the bending zone 14 when the drilling assembly is in a predetermined proper location relative to the bending zone 14. Herein, the springs 346 pull the levers 344 towards the motor 302. As a result, the grippers 324 will move outwards to engage the bending zone and the valves 326 will close the openings 324. When the openings 324 are closed, the pressure of the drilling fluid will increase, which again can be measured and observed at surface. Herein, increased pressure may include pressures in the range of about 70-80 bar, for instance.

FIG. 6 shows the drilling assembly when it is in a drilling position, i.e. a position preferred for drilling the borehole 1. Herein, the grippers 324 can expand in radial direction and are therefore located below the bending zone 14. This can be noticed at surface due to at least two effects. Firstly, the fluid pressure of the fluid 340 inside the drill string 20 will increase as the spring loaded valves 326 are closed. Secondly, after the increase of pressure is noted on the rig, a driller can subsequently confirm the position of the drilling assembly by pulling the grippers 324 back into the unexpanded section 8 past the bending zone 14. As the drill string 20 is being pulled back the driller will notice that the force or tension required to pull the drill string backwards will increase with a predetermined value or number (typically a few tones), and then suddenly drops to the previous level. This indicates that the grippers 324 have collapsed and are back inside the unexpanded section 8, i.e. the position shown in FIG. 5. At the same time the pressure of the drilling fluid 340 will drop back due to the re-opening of the spring loaded valves 326. Returning to the state as shown in FIG. 6, the closing of the spring loaded valves 326 causes increased fluid flow and fluid pressure in the under-reamer 26, which as a result will open to its expanded state, wherein the under-reamer has an enlarged outer diameter.

Figure 7:
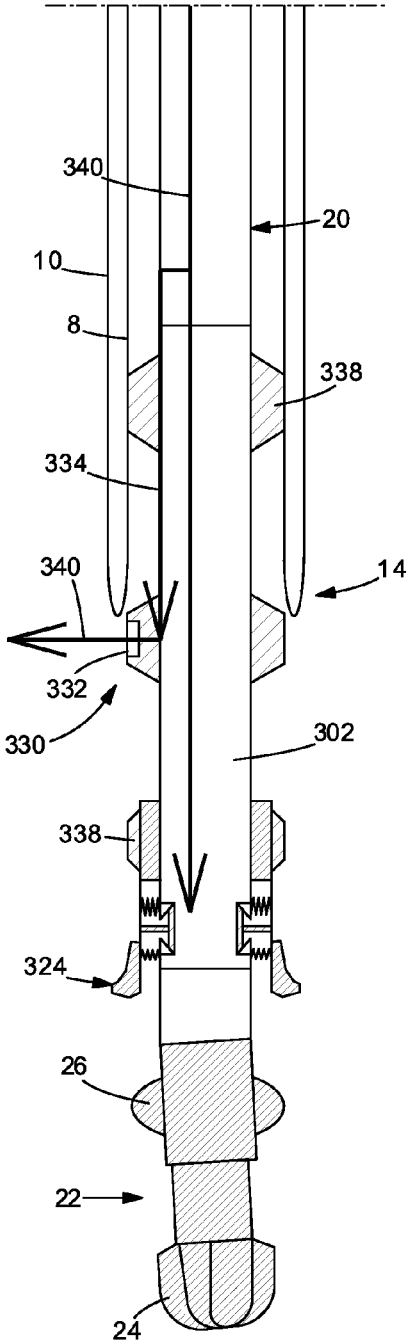
FIG. 7 shows a cross section of the embodiment of FIG. 5 in a third state.

When the drilling assembly 320 is too far ahead of the bending zone 14, as shown in FIG. 7, the pressure release system 330 passes the bending zone 14, wherein the fluid chamber 332 opens. As the open fluid chamber 332 provides a flow path for drilling fluid 340 towards the borehole 1, the pressure within the drilling assembly drops, which will be noticeable at surface on the drilling rig. Also, a pressure differential over the assembly of the motor 302, the under-reamer 26 and the pilot bit 24 will drop below a threshold pressure level whereat the bit rotates slower and the under-reamer will retract to its collapsed position. Effectively, the drilling assembly 320 will stop drilling. Herein, the threshold pressure level is for instance about 55 bar or less, for instance in the order of about 50 bar.

Figure 8:
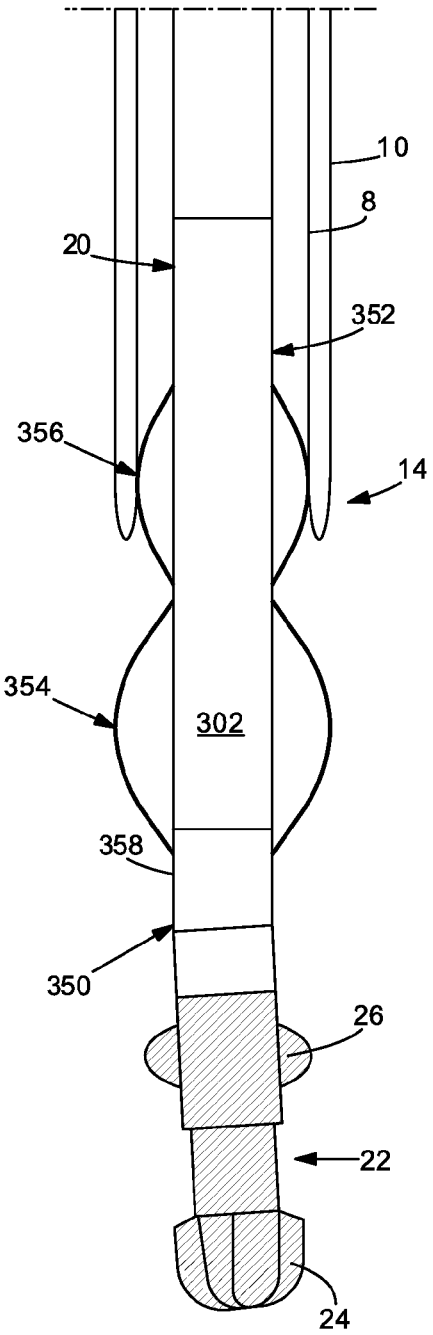
FIG. 8 shows a cross section of a detail of another embodiment of the system of the invention.

As shown in FIG. 8, the downhole motor 302 may comprise a bend housing part 350, which connects the drill bit 22 to a straight housing part 352. In an embodiment, an outer surface of the straight housing part 352 is provided with one or more spring elements 354, 356, which are moveable between a closed position and an open position. Herein, spring element 354 is shown in the open position and spring element 356 is shown in the closed position.

A problem of steering the drilling assembly 320, comprising the under-reamer in combination with the motor, is that the inner diameter of the borehole 1 will be too big to support the drilling assembly and prevent side-wards movement, i.e. movement in radial direction. When the borehole would be drilled using only the pilot bit 24, the bend housing 350 can engage the borehole wall at a support location 358 to push itself away from the wall of the borehole and transfer this radial force to the bit. However, in combination with the under-reamer 26 the diameter of the borehole will be too big for the support location 358 to engage the borehole wall.

The one or more spring elements 354, 356 ensure that the drilling assembly 320 is kept in the middle of the borehole when the under-reamer 26 is used, as shown in FIG. 8. The spring elements will contact the borehole wall to transfer a radial, side-wards force to the bend housing part 350. The spring elements are collapsed while the drill string is inside the unexpanded tubular section 8, see spring element 356. When one of the spring elements exits the unexpanded section 8, it moves to the open or expanded state, as shown by spring element 354.

The transfer from the closed position to the open position can be noticed at surface as a change in frictional force. Using the embodiment of FIG. 8, the pilot bit 24 and the under-reamer 26 can be further away from the bending zone 14, and the relative position is less critical compared to the embodiment of FIG. 5. Operation of the embodiment of FIG. 8 is comparable to the operation of the directional (horizontal) drilling system 300 of FIG. 4.

Figure 9:
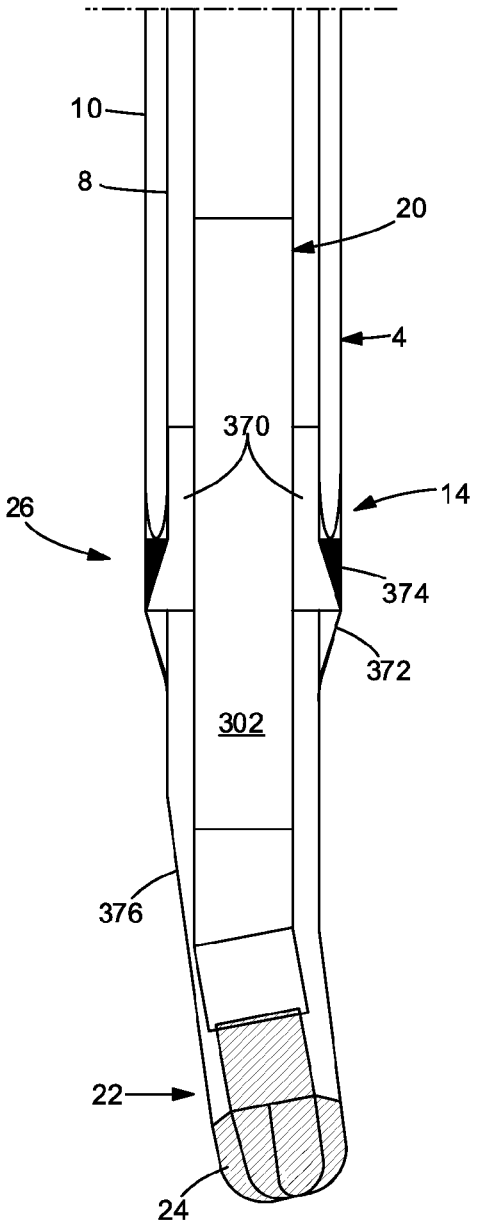
FIG. 9 shows a cross section of a detail of yet another embodiment of the system of the invention in a first state.

The embodiment shown in FIG. 9 comprises a knife holder 370 which is provided on the outside of the motor 302. One of more cutting wedges or knifes 372 are arranged in the knife holder. On the side facing the pilot bit 24, the knifes 372 are provided with wedge centralizers 374.

Figure 10:
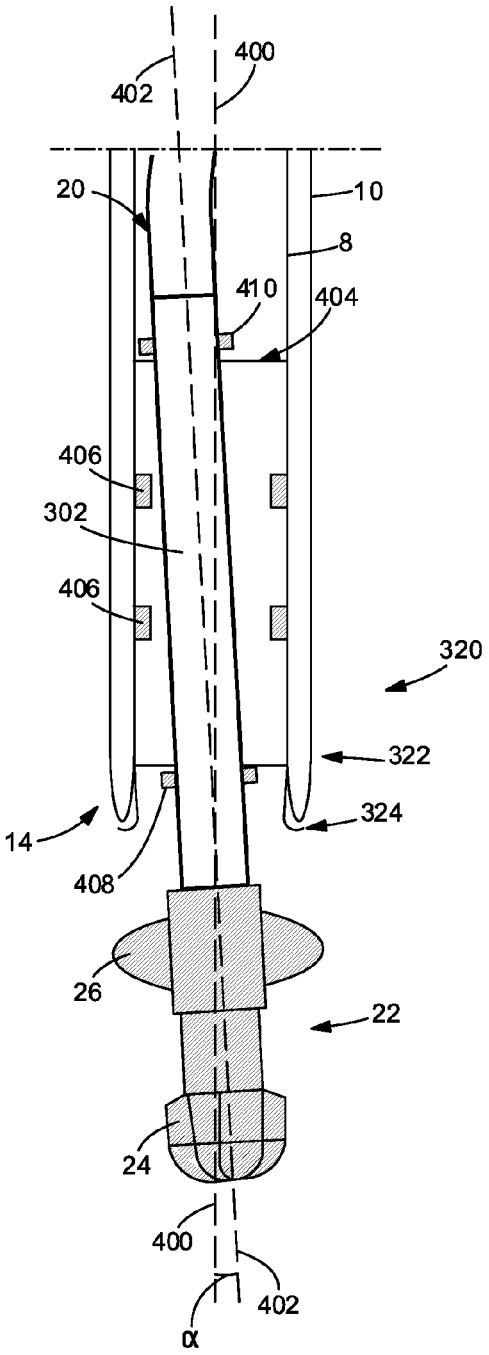
FIG. 10 shows a cross section of the embodiment of FIG. 9 in a second state.

During drilling, the pilot bit 24 creates a pilot hole 376 which is subsequently enlarged by the cutting wedge (i.e. a knife) 372. The cutting wedges 372 are pushed forward due to contact with the bending zone 14 of the tubular element 4. As shown in FIG. 10, the wedge 372 "slices" the formation 378 in front of the knife (indicated by sliced formation part 380), thus enlarging the diameter of the borehole 1 to the size needed to accommodate the inverted pipe 10. The cutting action generates a reaction force which pushes the bottom of the one or more knifes 372 against the bending zone 14 resulting in an increase in the force needed to invert the tubular element 4. Said force can be monitored at surface and indicates how hard it is to enlarge the borehole to the size of the inverted pipe 10. When said force exceeds a predetermined threshold, the bit 24 can be pulled back into the unexpanded tubular section 8 and the pilot hole 376 can be cleaned up by a combination of bit rotation of the pilot bit 24 and flow of drilling fluid.

The centralizer 374 in front of the wedge 372 ensures that the knife 372 cuts a concentric hole, with respect to the pilot hole 376. The remainder of the drilling assembly can be similar to the embodiments described above.

Figure 11:
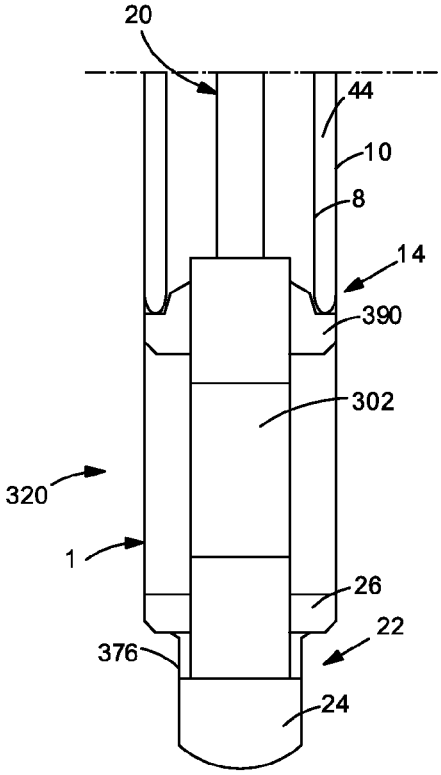
FIG. 11 shows a cross section of a detail of another embodiment of the system of the invention.

In the embodiment of FIG. 11, the drill string 20 may comprise coiled tubing, as well as drill pipe sections 28. The bottom hole assembly or drilling assembly 320 comprises a support element 390 for the bending zone 14, in addition to the motor 302, the under-reamer 26 and pilot bit 24 of the drill bit 22. Weight on the bit 22, such as caused by the force F shown in FIG. 4, is applied via the bending zone 14 which pushes against the support element 390, which transfers the force to the drill bit. Herein, the force to the bending zone is applied to the unexpanded section 8 at surface, for instance by the pipe pusher 42.

During running in and out, i.e. moving the drilling assembly in or out the borehole through the tubular element 4, retractable arms of the support element 390 for the bending zone 14 and the under-reamer are moved to a closed, retracted position having a reduced outer diameter. With bit on bottom, i.e. when the pilot bit 24 engages the extreme end of the borehole, said arms are open and the weight on bit can be transferred from the unexpanded section to the support 390 and the bit 22 due to movement of the bending zone 14 during inversion of the tubular element 4.

The operation of the system of the invention can be described referring to FIG. 1. The tubular element 4 extends into the wellbore 1. The liner 4 has been partially radially expanded by eversion of the wall thereof, forming a radially expanded tubular section 10 which extends concentrically around the unexpanded section 8. The liner 4 is, due to eversion at its lower end, bent radially outward and in axially reverse (for instance upward) direction so as to form a U-shaped lower section, defining the bending zone 14 (FIG. 1).

During normal operation of the system of the invention, the lower end portion of the yet unexpanded liner 4 is bent radially outward and in axially reverse direction in any suitable manner, forming the U-shaped lower section 12. After an predetermined length of the liner 4 has been everted, the expanded liner section 10 can be axially fixed by any suitable means.

A downward force F of sufficient magnitude is then applied to the unexpanded liner section 8 in order to move the unexpanded liner section 8 gradually into the expanded liner section 10. As a result, the unexpanded section 8 progressively bends in reverse direction thereby progressively transforming the unexpanded liner section 8 into the expanded liner section 10. During the eversion process, the bending zone 14 moves at approximately half the speed of the unexpanded section 8.

To steer the drilling assembly 320 during drilling, the embodiments shown in FIGS. 12-21 and described herein below can be used. The embodiments of FIGS. 12-21 can be combined with any of the embodiments for controlling the relative position of the bit 22 with respect to the bending zone 14, as shown in FIGS. 5-11.

Figure 12:
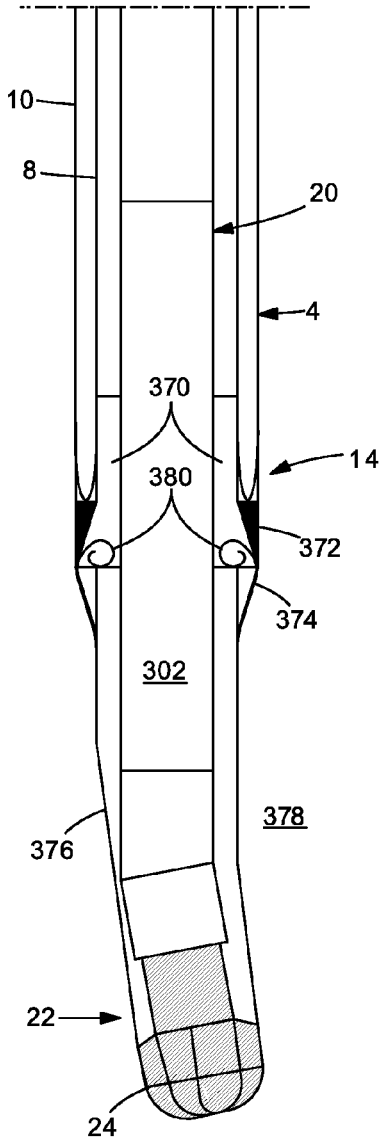
FIG. 12 shows a cross section of an embodiment of the present invention.

In the embodiment of FIG. 12, a drilling assembly centreline 402 of the drilling assembly 320 is tilted with respect to the centreline 400 of the unexpanded section 8 at an angle $\alpha$ (FIG. 12). The system comprises the positioning tool 322, for instance including the grippers 324. A cylindrical sleeve 404, which is intended to be kept stationary or non-rotating during use, encloses part of the motor 302. The sleeve 404 may be provided with one or more friction pads 406 to engage the inner surface of the unexpanded section 8. At opposite ends of the sleeve 404, the motor housing is provided with respective bearing rings 408, 410.

During drilling, the friction pads 406 maintain the sleeve 404 non-rotating. The grippers 324 can be used to control the position of the drilling assembly with respect to the bending zone 14, preferably to maintain the non-rotating sleeve 404 directly behind the bending zone 14 and inside the unexpanded pipe section 8. The rotating drill string 20 may be pushed forward, into the borehole, by the non-rotating sleeve 404 acting on the bearing ring 408.

Figure 13:
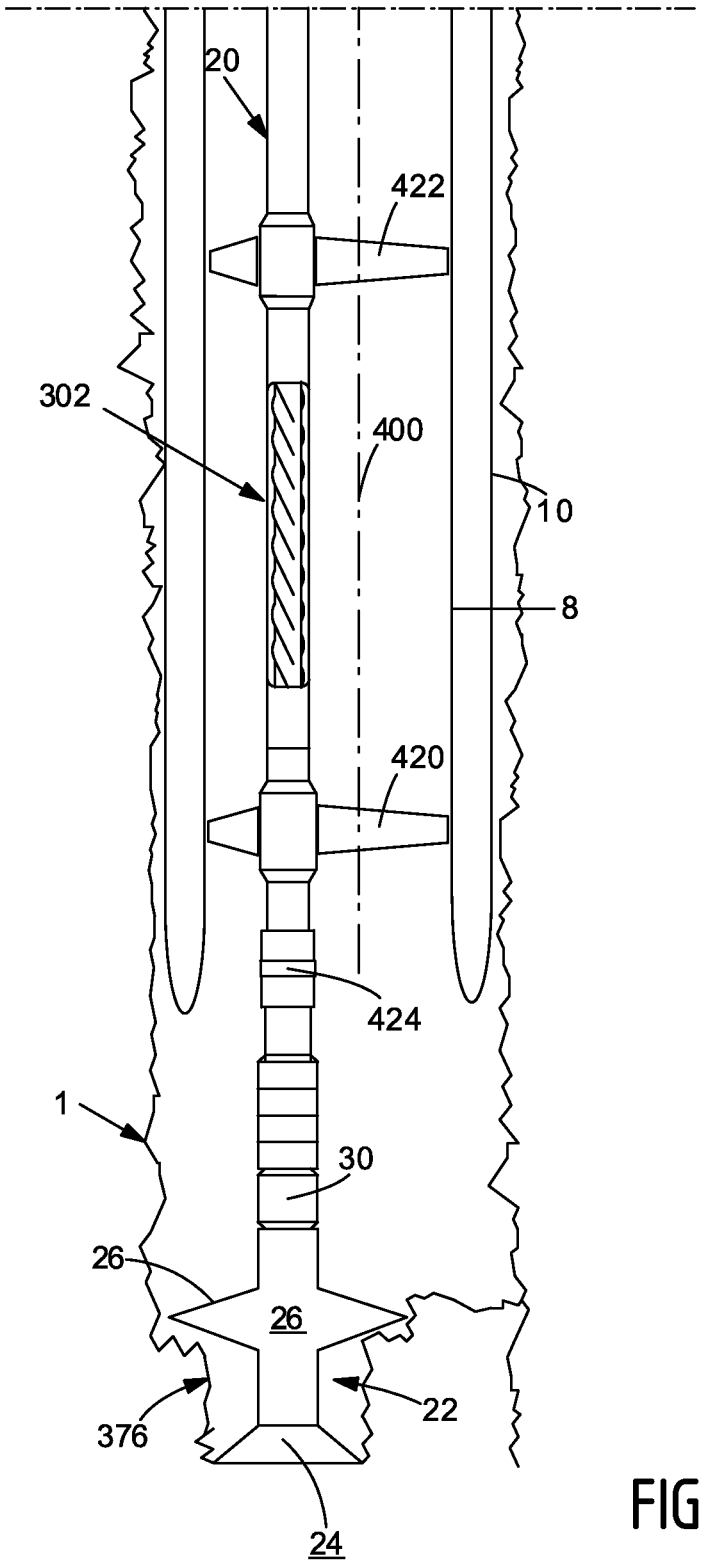
FIG. 13 shows a cross section of another embodiment of the present invention.

In another embodiment, shown in FIG. 13, the motor 302 is mounted with an offset from the casing centreline 400, i.e. eccentric. As a result, also the pilot bit 24 and/or the underreamer 26 are arranged eccentric. Herein, preferably the pilot bit 24 and the under-reamer 26 constitute a so-called bi-center bit, which is an integral drill bit combined with an eccentric under-reamer 26. The drilling assembly is provided with one, two or more eccentric stabilizers 420, 422 to stabilize the drilling assembly within the tubular element 4 during drilling and to maintain the drilling assembly in its eccentric position. An adjustable kick off 424 is set at zero degrees. A kick-off assembly consists of the downhole drilling motor 302 and the adjustable kick off (AKO) 424. The AKO can be set to give a reasonable amount of curvature to direct the bit towards the target zone.

Figure 14:
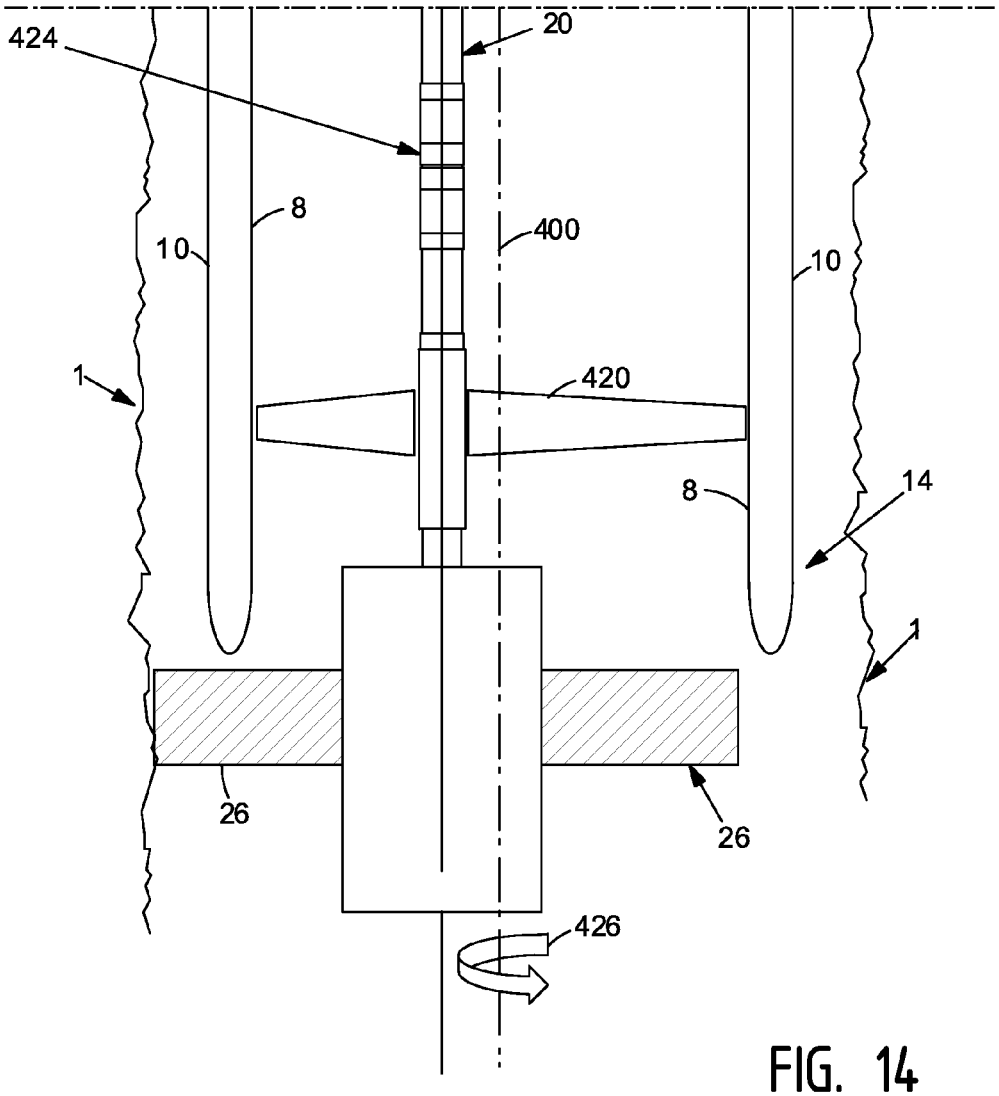
FIGS. 14-17 show cross sections of a detail of the embodiment of FIG. 13 in different states of use.

As shown in FIG. 14, in a first step the whole drill string 20 is rotated, causing the drilling assembly to rotate around the centreline 400 as indicated by arrow 426. This is called the rotary mode, wherein the borehole advances straight, along the direction of the centreline 400. Herein, the inner diameter of the borehole 1 will be larger than the outer diameter of the under-reamer 26.

Figure 15:
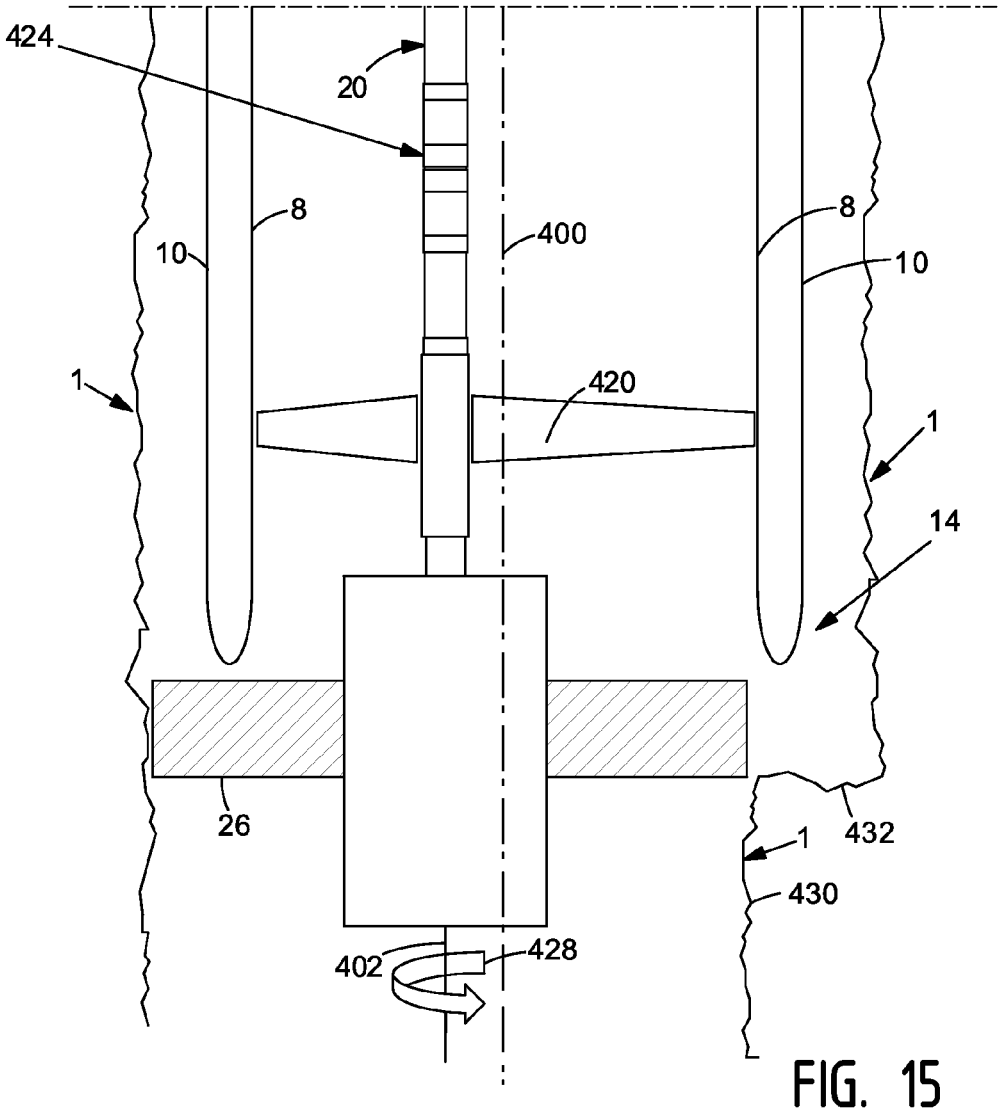

As shown in FIG. 15, in a second step the drill string 20 stops rotating and the downhole motor 302 is acticated to rotate the pilot bit 24 and the under-reamer 26 around the centreline 402 of the drilling assembly, as indicated by arrow 428. This is called the sliding mode, wherein a borehole section 430 is drilled which has an inner diameter substantially equal to the outer diameter of the under-reamer 26, leaving a shoulder 432. The shoulder 432 is a stepwise change in the borehole. The size of the step or shoulder 432 is for instance in the order of 5 to 10 mm.

Figure 16:
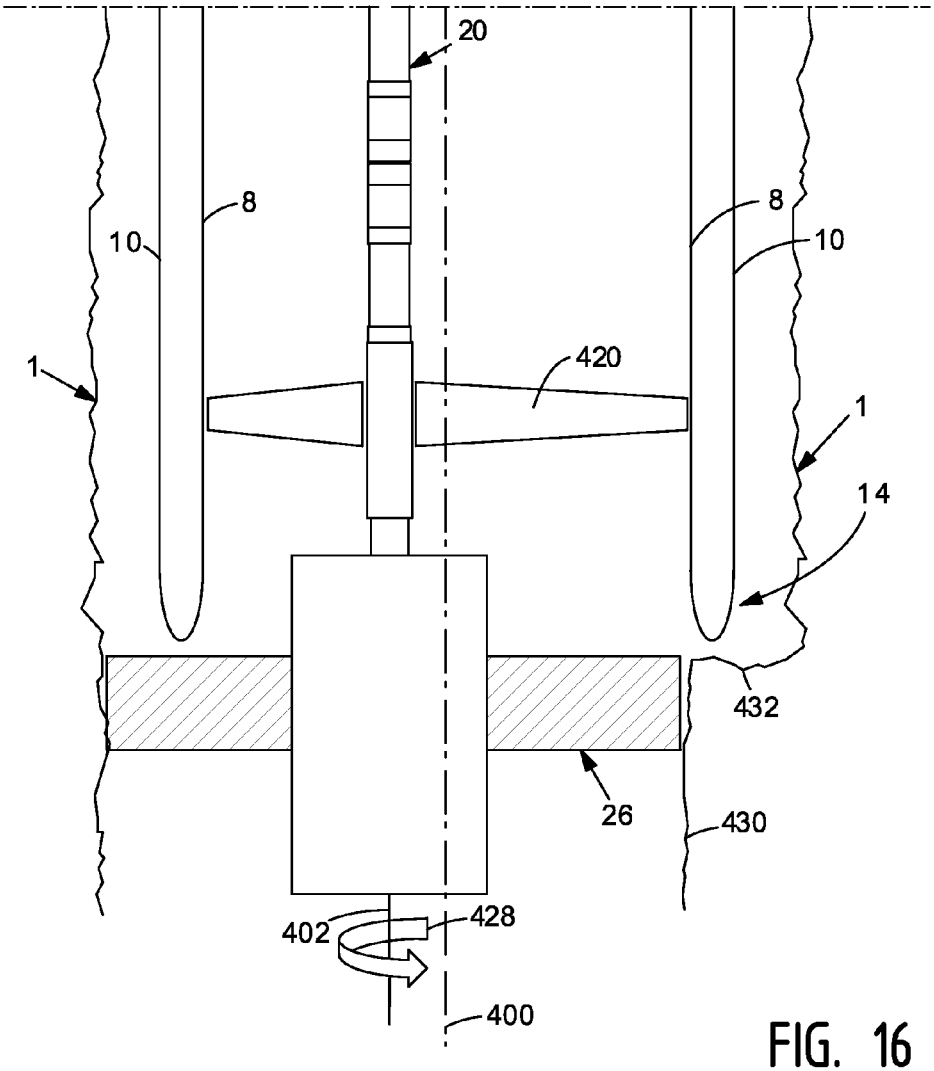
Figure 17:
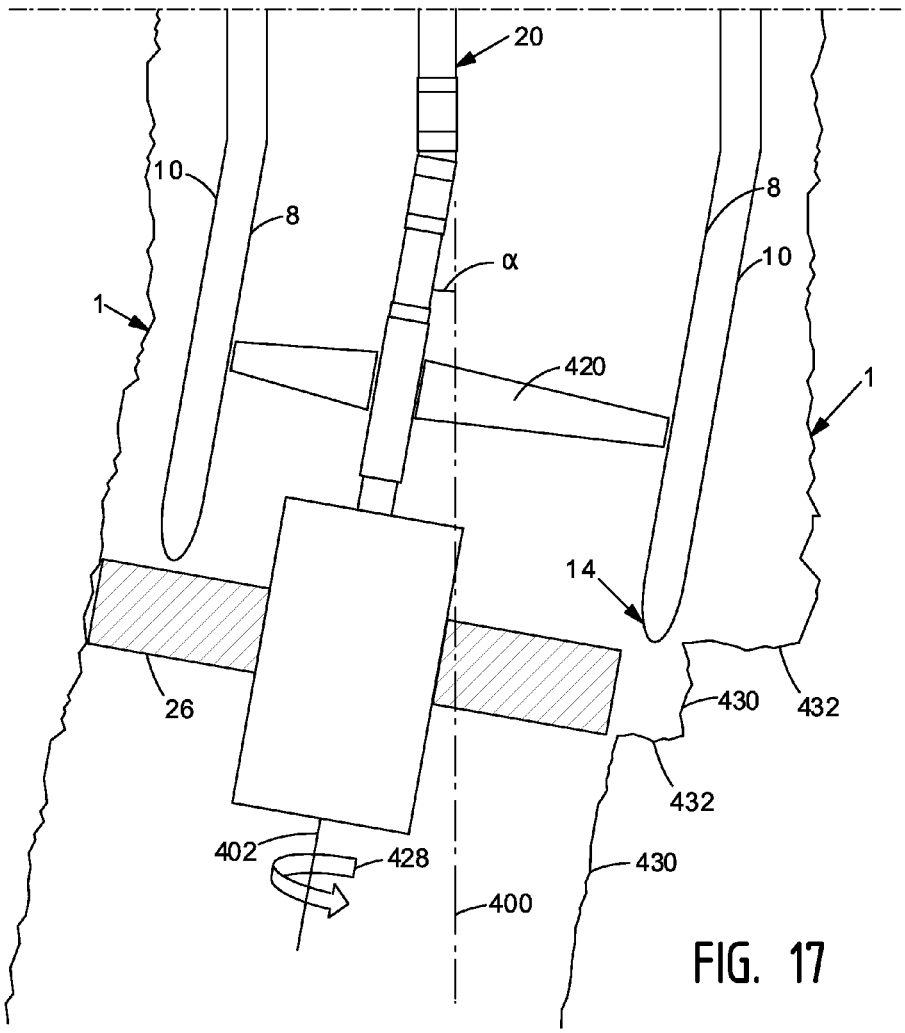
Figure 18:
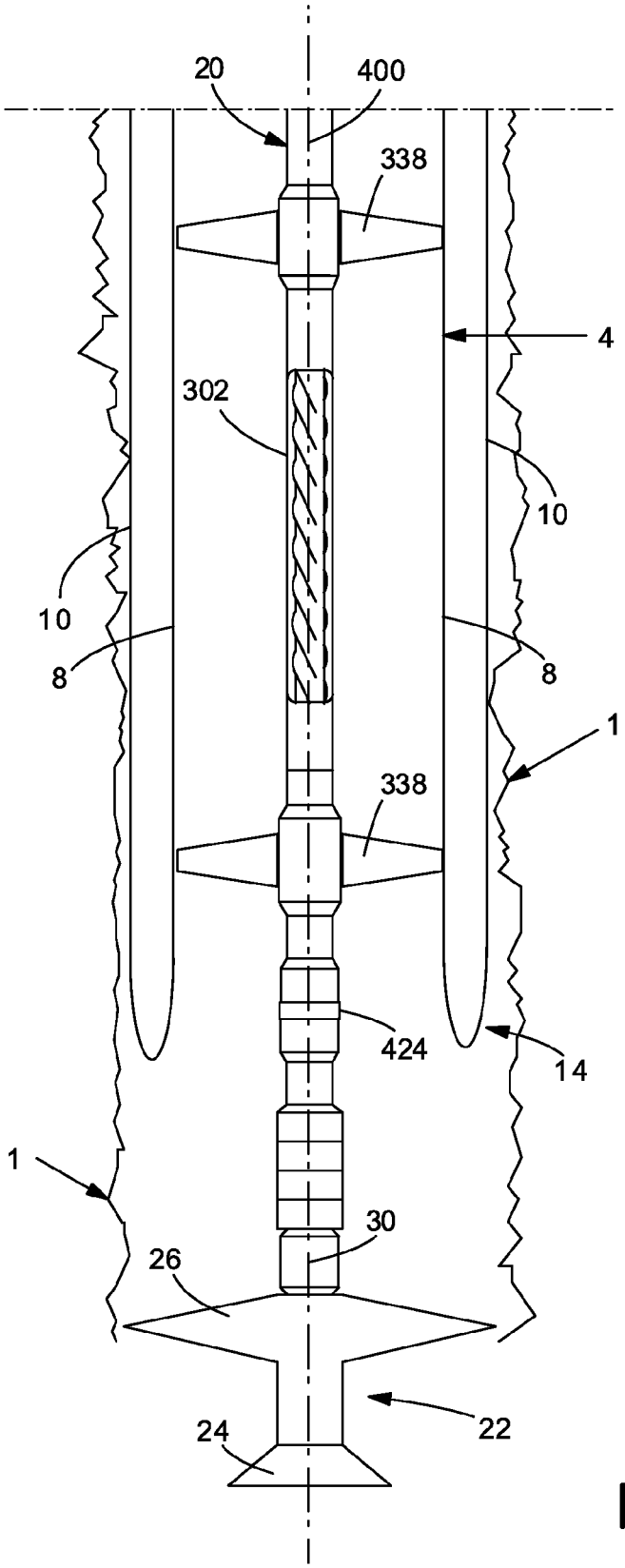
FIG. 18 shows a cross section of another embodiment of the present invention.
Figure 19:
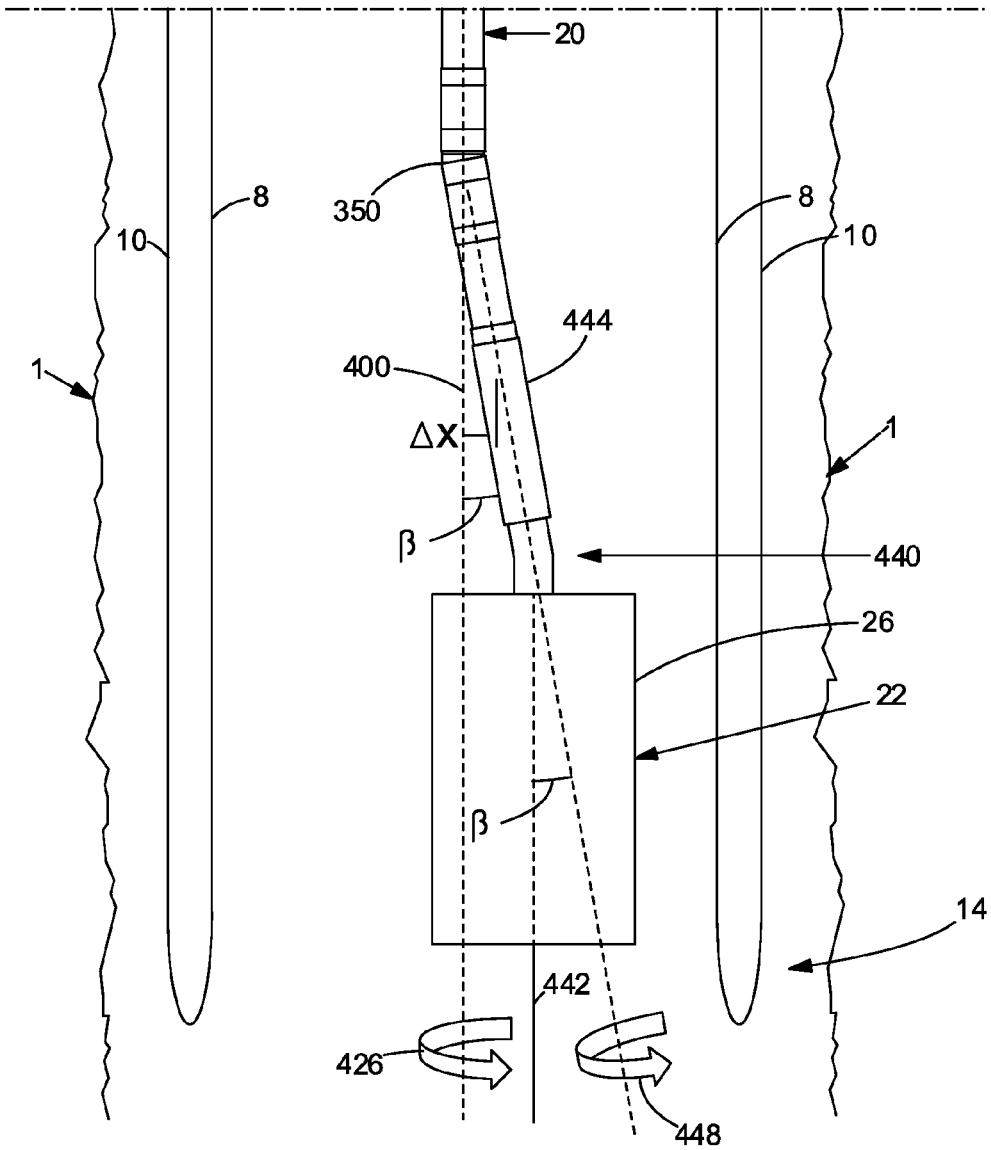
FIGS. 19-21 show cross sections of a detail of the embodiment of FIG. 18 in different states of use.
Figure 20:
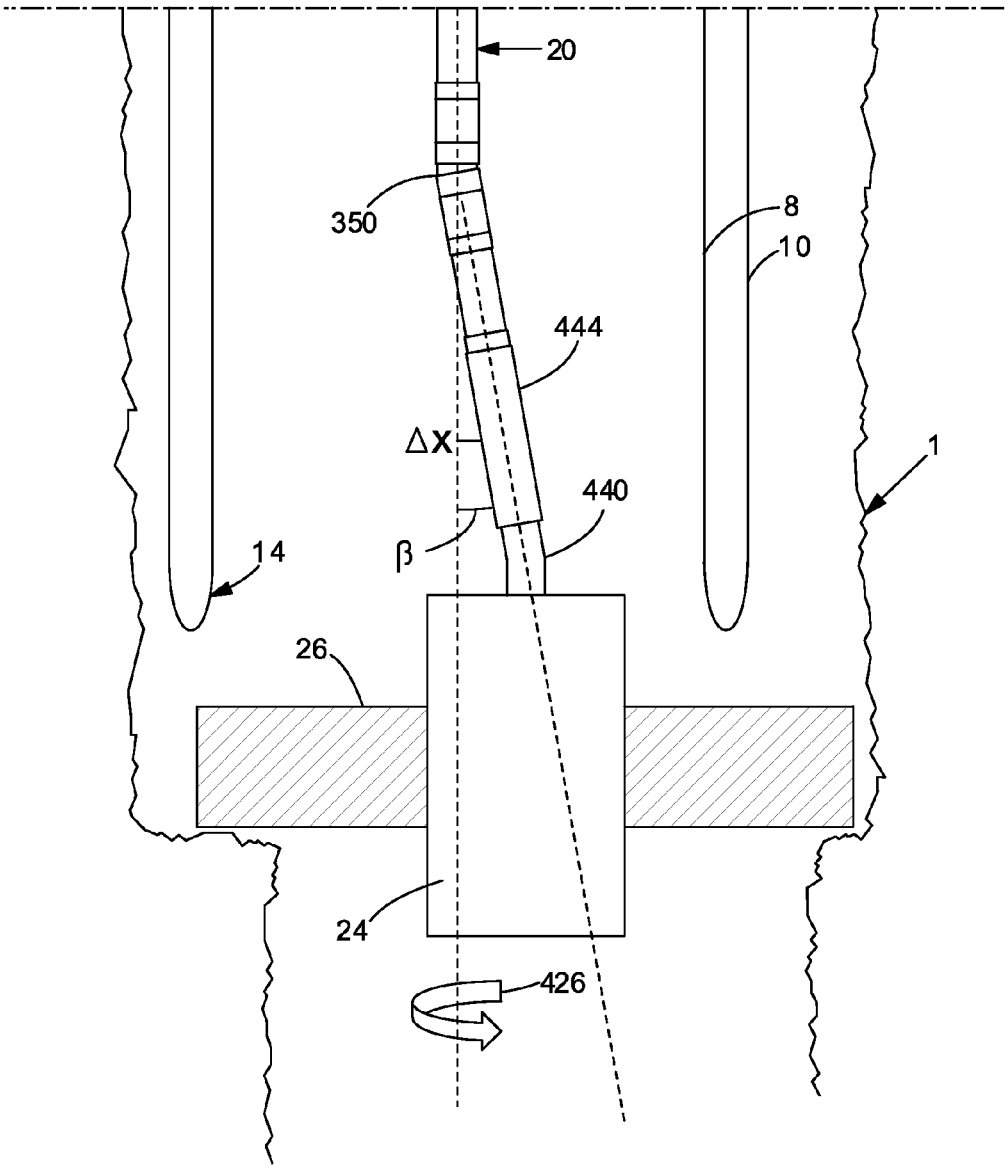

During the second step, the bit 22 including the under-reamer 26 advances until the bending zone 14 engages the shoulder 432 (FIG. 16).

In a subsequent step (FIG. 17), still in the sliding mode, the bending zone 14 will roll against the shoulder 432. Herein, the angle $\alpha$ between the centreline 402 and the centreline 400 increases, and consequently the trajectory of the wellbore 1 changes. As indicated, drilling may be continued in the sliding mode, so that a sequence of shoulders 432 is created.

In yet another embodiment (FIG. 18), the motor 302 is arranged on the centreline 400 of the tubular element 4. The motor is provided with stabilizers 338 to stabilize it within the unexpanded section 8 during drilling.

The AKO 424 may be set at an angle β (FIG. 19), for instance in the order of 0.5 degrees. Herein, the angle β is included twice, i.e. also at the bend connection 440 between a bent-sub 444, having centreline 446, and the drill bit 22. The centreline 442 of the under-reamer 26 (in its collapsed mode having a reduced diameter) extends parallel to the centreline 400. The drill bit 22 may also be rotated around the axis of the bent-sub, as indicated by arrow 448.

When the under-reamer has advances beyond the bending zone 14, it is moved to the expanded state having an enlarged diameter. In rotary mode (FIG. 20), the drill string 20 including the drill bit 22 is rotated around the centreline 400, as indicated by arrow 426. Herein the borehole will advance straight, along the centreline 400.

Figure 21:
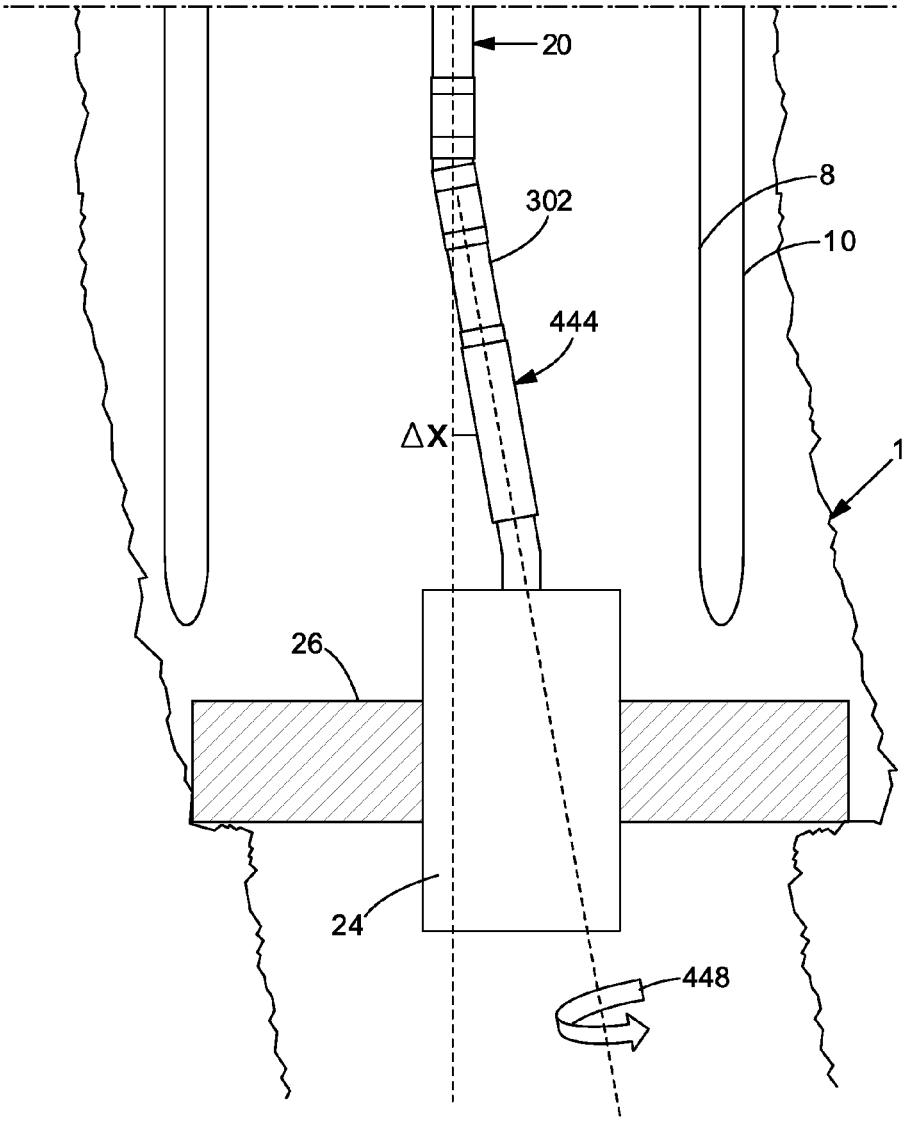

In sliding mode (FIG. 21), the drill string does not rotate while the motor 302 is activated to rotate the pilot bit 24 and the under-reamer 26 around the centreline of the bent-sub 444, as indicated by the arrow 448. While drilling in the sliding mode, the borehole will start to deviate from the centreline 400, as indicated in FIG. 21.

Figure 22:
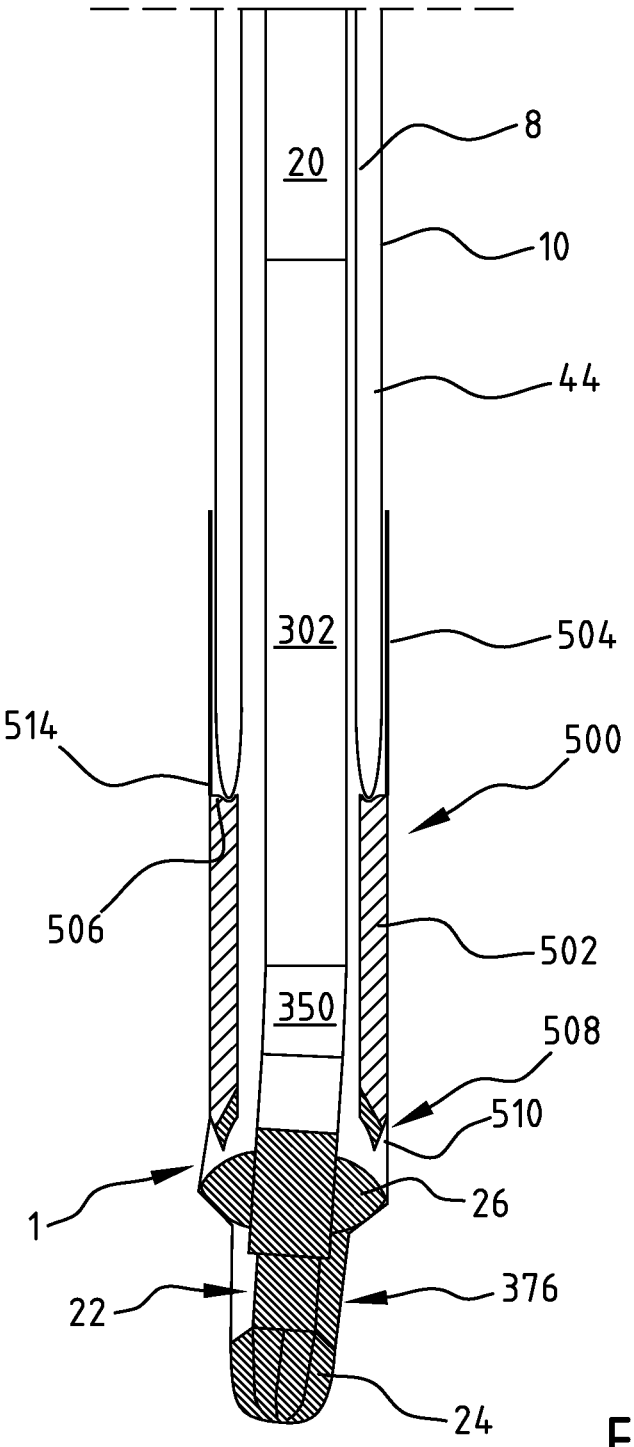
FIG. 22 shows a cross-sectional side view of yet another embodiment of the system of the invention.

FIG. 22 shows an improved embodiment of the system of the invention comprising a guiding sleeve 500 for guiding the bending zone 14 through the borehole 1. Herein, several features for directional drilling as described above with respect to other embodiments are not shown to improve the clarity of FIG. 22, but any of said features may be combined with the embodiment of FIG. 22.

In an embodiment, the guiding sleeve 500 comprises a front section 502 and an aft section 504. The tubular aft section 504 encloses an end of the expanded tubular section 10, starting at the bending zone 14. The tubular front section 502 extends in front of the bending zone 14 and comprises a curved contact surface 506 for engaging the bending zone 14 of the liner. The curvature of the contact surface 506 may be substantially similar to the expected curvature of the outside of the bending zone. A wall thickness of the front section may be in the order of the combined thickness of the expanded section 10, the unexpanded tubular section 8 and the annulus 44 respectively. The front section may comprise a nose section 508. The nose section preferably includes a wedged end 510 to enable the nose section to pass irregularities of the wellbore wall. The wedged end 510 may include a taper on the outside, i.e. facing the wellbore wall. Additionally, the wedged end may also include a tapered edge 512 on the inside facing the drill string (see FIG. 24). If so, the end of the wedged end 510 may be about in the middle between the two tapered surfaces.

The front section 502 and the aft section 504 may be connected by a flexible middle section 514, to allow the guiding sleeve to follow a curved wellbore. Alternatively, the front section 502 and/or the aft section 504 may be made of a material having a flexibility which is suitable to follow the expected curve of the wellbore. Such flexible material may for instance include suitable metals and steels, such as spring steel.

Figure 23:
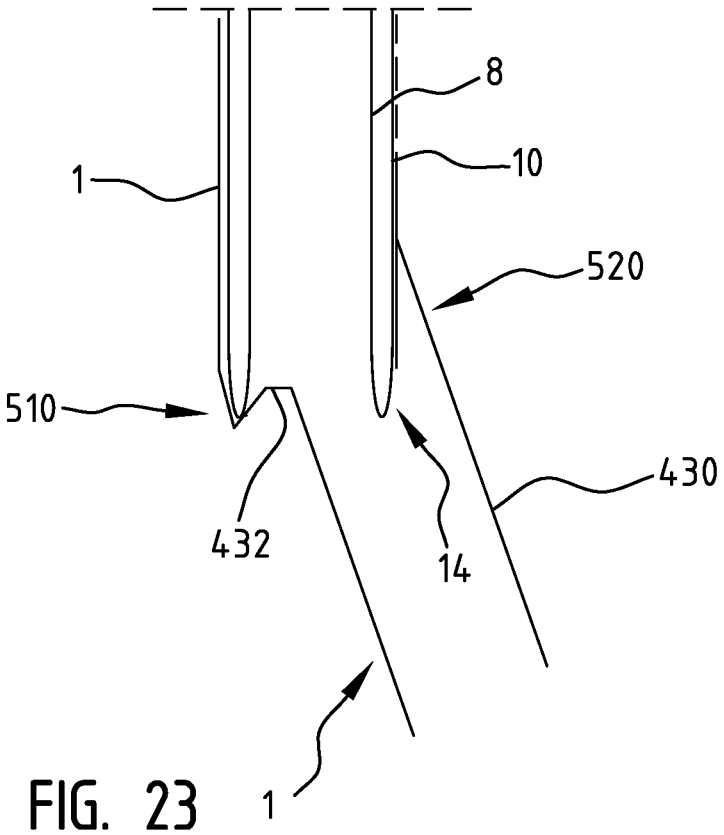
FIG. 23 shows a schematic cross-sectional side view of a problem solved by the embodiment of FIG. 22.

FIG. 23 shows an example of a curved wellbore section 520, including the deviating borehole section 430 and the shoulder 432. Unintentionally, the shoulder 432 may include an irregularity 522 which may trap the bending zone 14 and prevent the bending zone from proceeding further down the borehole. Herein, please bear in mind that the dimensions of the shoulder and the irregularity 522 are exaggerated in FIG. 23, for sake of clarity.

Figure 24:
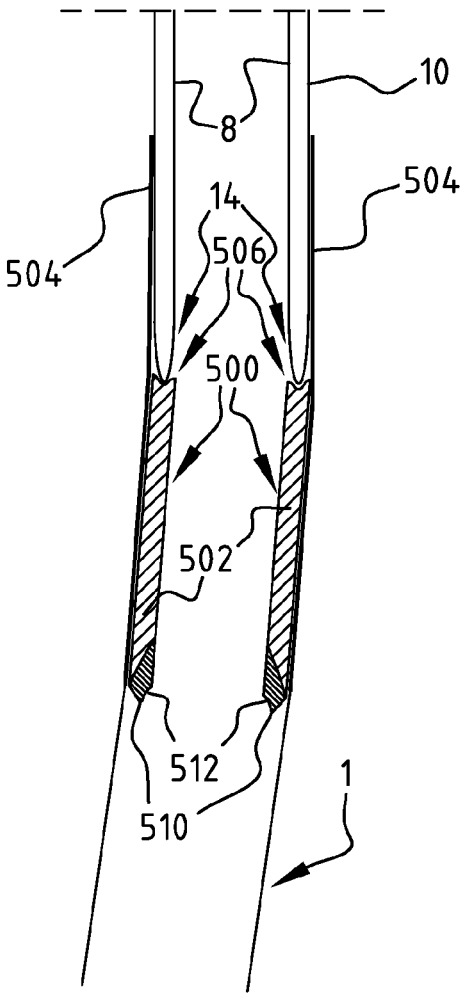
FIGS. 24 and 25 show subsequent steps in a method of drilling a wellbore using the system shown in FIG. 22.
Figure 25:
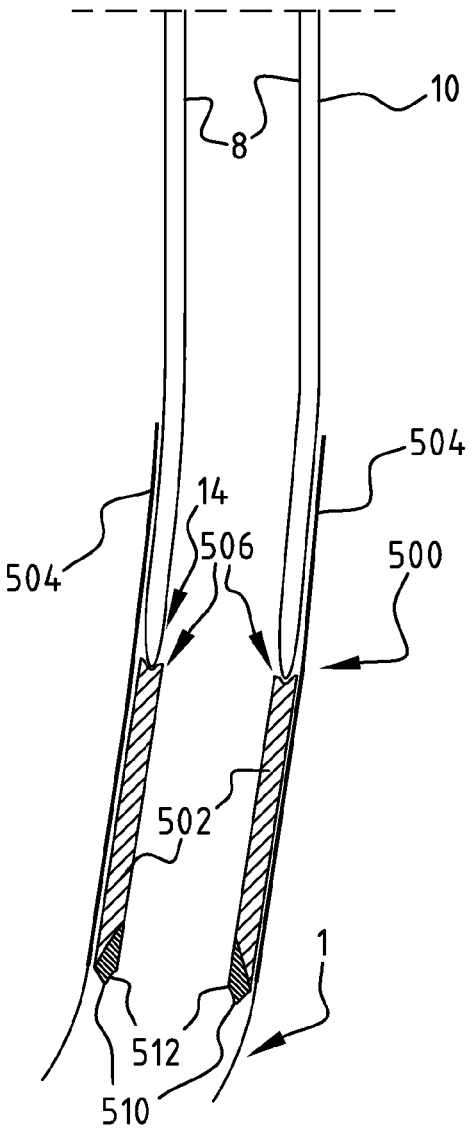

During drilling, as shown in FIGS. 24 and 25, the nose section 508 enables the front section 502 to pass irregularities in the wellbore wall, whereas the aft section shields the bending zone from the wellbore wall, thus preventing trapping of the bending zone.

In a practical embodiment, the aft section overlapping the expanded liner section 10 may have a length in the range of 20 cm up to 4 m, for instance about 50 cm. The length may vary depending on for instance the diameter of the wellbore or the wall thickness of the expanded section 10. The front section may have a length in the range of 20 cm to 1 m, for instance about 50 to 70 cm. The wedged end 510 may have a length in the range of 1 to 10 cm, for instance about 2 to 5 cm.

Optionally, the surface roughness of the internal surface of the aft section 504 may be increased to increase the friction between said surface and the expanded tubular section 10. As a result, during eversion of the liner 4 the movement of the aft section with respect to the expanded section 10 thereof will create friction, which in turn will pull the curved surface 506 towards the bending zone 14.

If desired, the diameter and/or wall thickness of the liner 4 can be selected such that the expanded liner section 10 becomes firmly compressed against the wellbore wall as a result of the expansion process so as to seal against the wellbore wall and/or to stabilize the wellbore wall. Since the length, and hence the weight, of the unexpanded section 8 gradually increases, the magnitude of the downward force F, which is applied to the unexpanded section for instance by the pipe pusher 42, can be decreased gradually in correspondence with the increased weight of unexpanded section 8.

When it is required to retrieve the drill string 20 to surface, for example when the drill bit is to be replaced or when drilling of the wellbore 1 is completed, the support ring and/or reamer section 26 are radially retracted. Subsequently the drill string 20 is retrieved through the unexpanded liner section 8 to surface. The support element 390 can remain downhole. Alternatively, the support element 390 can be made collapsible so as to allow it to be retrieved to surface in collapsed mode through the unexpanded liner section 8.

Locally heating the tubular element near the bending zone may reduce the strain in the area of deformation, thereby improving the integrity of the expanded section. Improving the integrity includes the reduction or elimination of damage to the tubular element. Heating the bending zone may enable the use of a tubular element having a thicker and/or stronger wall.

The wall thickness of the tubular element may be equal to or thicker than about 2 mm (0.08 inch). The wall is for instance more than 2.2 mm thick, for instance about 2.5 to 50 mm thick or about 2.8 to 30 mm. The outer diameter of the unexpanded section may be equal to or larger than about 50 mm (2 inch), for instance in the range of about 50 to 400 mm (16 inch). The expanded section may have an outer diameter which is suitable for or commonly used in hydrocarbon production.

The wall of the liner may comprise a relatively strong material, such as a metal or preferably steel, or be made of solid metal or steel. Thus, the liner 4 can be designed to have adequate collapse strength to support a wellbore wall and/or to withstand internal or external pressures encountered when drilling for hydrocarbon reservoirs.

The collapse strength of the tubular element can be set at any predetermined level, depending on wall thickness and material properties. In practical embodiments, the collapse strength of the tubular element 4 can be in the range of 200 bar to 1600 bar or more.

The embodiments described above are for instance suitable for drilling boreholes having an internal diameter of about 16 inch (about 40 cm) or less, for instance about 6 inch (about 15 cm) or less. The embodiments may for instance be applied using drill string having an outer diameter of about 2⅜ inch (about 6 cm). Tool joints, including the connections 30 to connect drill string sections 28, may have an outer diameter of about 2⅝ inch. The system may include a mud motor, which is a positive displacement motor having relatively high torque and low rpm (rotations per minute). The drill bit 22 may have an outer diameter of about 3⅞ inch. The underreamer 26 may be moveable between a collapsed state (not shown), having an outer diameter of about 3¾ inch (about 9-10 cm), and an open state (FIG. 1) having an outer diameter of about 5.1 inch. Other drill bits and underreamers commonly used when drilling for hydrocarbons may also be used.

With the method described above, it is achieved that the wellbore is progressively lined with the everted liner directly above the drill bit, during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the relatively short open-hole section L1 (see FIG. 1) during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals. Open hole section herein indicates the section of the wellbore which is not yet lined. With the system of the invention, the open hole section may have a length L1 of less than about 500 m, for instance less than about 100 m.

Also, if the wellbore is drilled through a shale layer, such short open-hole section eliminates possible problems due to heaving of the shale.

In addition, the system and method of the present invention enable directional drilling while at the same time lining the borehole with a liner having sufficient strength to support the borehole wall. Herein, the system of the present invention is able to control the distance between the drill bit and the bending zone, which ensures that the open hole section is maintained relatively short as mentioned above.

After the wellbore 1 has been drilled to the desired depth and the drill string 24 has been removed from the wellbore, the length of unexpanded liner section 8 that is still present in the wellbore 1, can be left in the wellbore or it can be cut-off from the expanded section 10 and retrieved to surface.

In case the length of unexpanded liner section 8 is left in the wellbore 1, there are several options for completing the wellbore. These are, for example, as follows.

A) A fluid, for example brine, is pumped into the annular space between the unexpanded and expanded liner sections 8, 10 so as to pressurise the annular space and increase the collapse resistance of the expanded liner section 10. Optionally one or more holes are provided in the U-shaped lower sections 16, 20 to allow the pumped fluid to be circulated.

B) A heavy fluid is pumped into the annular space so as to support the expanded liner section 10 and increase its collapse resistance.

C) Cement is pumped into the annular space to create, after hardening of the cement, a solid body between the unexpanded liner section 8 and the expanded liner section 10, whereby the cement may expand upon hardening.

D) The unexpanded liner section 8 is radially expanded against the expanded liner section 10, for example by pumping, pushing or pulling an expander (not shown) through the unexpanded liner section 8.

In the above examples, expansion of the liner is started at surface or at a downhole location. In case of an offshore wellbore, wherein an offshore platform is positioned above the wellbore above the surface of the water, it can be advantageous to start the expansion process at the offshore platform. Herein, the bending zone moves from the offshore platform to the seabed and from there further into the wellbore. Thus, the resulting expanded tubular element not only forms a liner in the wellbore, but also a riser extending from the offshore platform to the seabed. The need for a separate riser from is thereby obviated.

Furthermore, conduits such as electric wires or optical fibres for communication with downhole equipment can be extended in the annular space between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after the eversion process is finalised, is subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or collapse rating.

Instead of leaving a length of unexpanded liner section in the wellbore after the expansion process, the entire liner can be expanded with the method of the invention so that no unexpanded liner section remains in the wellbore. In such case, an elongate member, for example a pipe string, can be used to exert the necessary downward force F to the unexpanded liner section during the last phase of the expansion process.

In order to reduce friction forces between the unexpanded and expanded tubular sections during the expansion process described in any of the aforementioned examples, suitably a friction reducing layer, such as a Teflon layer, is applied between the unexpanded and expanded tubular sections. For example, a friction reducing coating can be applied to the outer surface of the tubular element before expansion. Such layer of friction reducing material furthermore reduces the annular clearance between the unexpanded and expanded sections, thus resulting in a reduced buckling tendency of the unexpanded section. Instead of, or in addition to, such friction reducing layer, centralizing pads and/or rollers can be applied between the unexpanded and expanded sections to reduce the friction forces and the annular clearance there-between.

Instead of expanding the expanded liner section against the wellbore wall (as described above), the expanded liner section can be expanded against the inner surface of another tubular element already present in the wellbore.

The method and system of the present invention can be applied for drilling and at the same time lining wellbores for hydrocarbon production. In addition, the method and system can be applied to create (curved) pipelines. Such pipelines may for instance pass under a river (a so-called river crossing), a road or one or more buildings. Herein, the method of the invention enables to drill a pilot hole, an enlarged reamed hole and to line said enlarged hole at the same time. Thus the system obviates multiple trips for running drill string and/or liner in or out of the borehole, thus saving time and money. In addition, the system enables to install a (metal or steel) liner pipe having sufficient strength to support the borehole wall.

The invention described herein above may be combined with rollers, as previously described in WO-2008/061969, and/or with longitudinal grooves on the outer surface or the inner surface of the tubular element, as described in WO-2008/049826, both of which are for the respective purpose enclosed herein by reference. The present invention may also be combined with a blow-out preventer, for instance as disclosed in European Patent Application No. 10190010.8, which is for this purpose enclosed herein by reference.

Many modifications of the above described embodiments are conceivable, within the scope of the attached claims. Features of respective embodiments may for instance be combined.

That which is claimed is:

1. A method for radially expanding a tubular element, the method comprising the steps of:

bending the tubular element radially outward and in axially reverse direction so as to form an expanded tubular section extending around an unexpanded tubular section, wherein bending occurs in a bending zone;

increasing the length of the expanded tubular section by pushing the unexpanded tubular section in axial direction relative to the expanded tubular section;

operating a drill string, which extends through the unexpanded tubular section and is provided with a drill bit at a downhole end thereof, to drill a borehole; and operating directional drilling means, which are coupled to the drill string, to deviate the borehole and direct the borehole along a predetermined path, wherein the directional means include reference means for indicating a relative distance between the drill bit and the bending zone, wherein the reference means include: a positioning tool and a pressure release system, wherein the positioning tool includes at least one gripper for engaging the bending zone, and wherein the pressure release system includes at least one spring loaded valve, which is coupled to the at least one gripper, for opening or closing a corresponding opening in the drill string depending on the position of the at least one gripper relative to the bending zone.

2. The method of claim 1, wherein the pressure release system includes at least one fluid chamber, which is adapted to seal against an inner surface of the unexpanded tubular section, and a conduit to connect the fluid chamber to an internal fluid passage inside the drill string.

3. The method of claim 2, wherein said fluid chamber is provided with seals that are capable of sealing the fluid chamber with respect to the inner surface of the unexpanded tubular section, which seals are adapted to open or close as a function of the position of the drill bit relative to the bending zone.

4. The method of claim 1, wherein the directional drilling means include one, two or more stabilizers for engaging the inner surface of the unexpanded tubular section.

5. The method of claim 1, wherein the drill bit comprises a pilot bit and an under-reamer.

6. The method of claim 1, wherein the downhole end of the drill string is provided with a motor for rotating the drill bit.

7. The method of claim 6, wherein at least part of the motor extends at an angle with respect to the centreline of the unexpanded tubular section.

8. A method for radially expanding a tubular element, the method comprising the steps of:

bending the tubular element radially outward and in axially reverse direction so as to form an expanded tubular section extending around an unexpanded tubular section, wherein bending occurs in a bending zone;

increasing the length of the expanded tubular section by pushing the unexpanded tubular section in axial direction relative to the expanded tubular section;

operating a drill string, which extends through the unexpanded tubular section and is provided with a drill bit at a downhole end thereof, to drill a borehole; and operating directional drilling means, which are coupled to the drill string, to deviate the borehole and direct the borehole along a predetermined path, wherein the directional drilling means include one, two or more stabilizes for engaging the inner surface of the unexpanded tubular section and wherein the stabilizers include spring elements, which are moveable between a closed position for engaging the inner surface of the unexpanded tubular section and an open position for engaging the borehole wall.

9. The method of claim 8, wherein one or more of the stabilizers is eccentric relative to the centreline of the unexpanded tubular section.

10. A system for radially expanding a tubular element, comprising:

a tubular element being bend radially outward and in axially reverse direction so as to form an expanded tubular section extending around an unexpanded tubular section, wherein bending occurs in a bending zone;

a pipe pusher for increasing the length of the expanded tubular section by pushing the unexpanded tubular section in axial direction relative to the expanded tubular section;

a drill string for drilling a borehole, which extends through the unexpanded tubular section and is provided with a drill bit at a downhole end thereof; and directional drilling means, which are coupled to the drill string, to deviate the borehole and direct the borehole along a predetermined path, wherein the drilling directional means comprise:

reference means for indicating a relative distance between the drill bit and the bending zone, wherein the reference means include: a positioning tool and a pressure release system, wherein the positioning tool includes at least one gripper for engaging the bending zone and wherein the pressure release system that includes at least one spring loaded valve, which is coupled to the at least one gripper, for opening or closing a corresponding opening in the drill string depending on the position of the at least one gripper relative to the bending zone or one, two or more stabilizes for engaging the inner surface of the unexpanded tubular section and wherein the stabilizers include spring elements, which are moveable between a closed position for engaging the inner surface of the unexpanded tubular section and an open position for engaging the borehole wall.

11. The system of claim 10, comprising a guiding sleeve for guiding the bending zone through the borehole, the guiding sleeve comprising:

a front section extending in front of the bending zone; and an aft section connected to the front section and enclosing the expanded tubular section.

* * * * *